US012305494B2

(12) United States Patent
Sheth et al.

(10) Patent No.: US 12,305,494 B2
(45) Date of Patent: May 20, 2025

(54) HIGH VOLUME AXIAL FLOW ELECTRIC SUBMERSIBLE PUMP (ESP) PUMP STAGE

(71) Applicant: Halliburton Energy Services, Inc., Houston, TX (US)

(72) Inventors: Ketankumar Kantilal Sheth, Tulsa, OK (US); Donn J. Brown, Tulsa, OK (US); Gerald Glen Goshorn, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/072,240

(22) Filed: Nov. 30, 2022

(65) Prior Publication Data

US 2024/0175339 A1 May 30, 2024

(51) Int. Cl.
*F04D 1/06* (2006.01)
*E21B 43/12* (2006.01)
(Continued)

(52) U.S. Cl.
CPC ..... *E21B 43/128* (2013.01); *F04D 1/06* (2013.01); *F04D 7/04* (2013.01); *F04D 7/045* (2013.01);
(Continued)

(58) Field of Classification Search
CPC ..... F04D 1/025; F04D 1/04; F04D 29/183; F04D 29/181; F04D 29/185; F04D 3/00; F04D 7/04; F04D 7/045; F04D 13/08; F04D 13/086; F04D 13/10; F04D 1/06; F04D 1/063; F04D 1/066; F04D 29/22; F04D 29/2205; F04D 29/2216; F04D 29/2211; F04D 29/2238; F04D 29/2255;
(Continued)

(56) References Cited

U.S. PATENT DOCUMENTS

2004/0096320 A1* 5/2004 Yevtushenko ..... F04D 31/00 415/199.5
2005/0186065 A1* 8/2005 Wilson ..... F04D 29/2288 415/1
(Continued)

FOREIGN PATENT DOCUMENTS

CN 10823424 A * 6/2018

OTHER PUBLICATIONS

English machine translation of CN-10823424-A, Jan. 13, 2024.*

*Primary Examiner* — Christopher Verdier
(74) *Attorney, Agent, or Firm* — Conley Rose, P.C.; Rodney B. Carroll

(57) ABSTRACT

An electrical submersible pump (ESP) assembly. The ESP assembly comprises an electric motor having a first drive shaft; a seal section having a second drive shaft that is coupled to the first drive shaft; a third drive shaft that is coupled to the second drive shaft; and an axial flow centrifugal pump stage, wherein the centrifugal pump stage comprises an impeller coupled to the third drive shaft and a diffuser, wherein the impeller defines a plurality of impeller vanes attached between an impeller hub and an impeller shroud, wherein the impeller shroud is a straight-walled cylindrical shape, wherein the diffuser defines a plurality of diffuser vanes attached between a diffuser hub and a diffuser shroud, and wherein the diffuser shroud is a straight-walled cylindrical shape.

25 Claims, 10 Drawing Sheets

(51) Int. Cl.

| | |
|---|---|
| ***E21B 43/38*** | (2006.01) |
| ***F04D 1/02*** | (2006.01) |
| ***F04D 1/04*** | (2006.01) |
| ***F04D 3/00*** | (2006.01) |
| ***F04D 7/04*** | (2006.01) |
| ***F04D 13/08*** | (2006.01) |
| ***F04D 13/10*** | (2006.01) |
| ***F04D 29/18*** | (2006.01) |
| ***F04D 29/22*** | (2006.01) |
| ***F04D 29/44*** | (2006.01) |
| ***F04D 29/54*** | (2006.01) |
| ***F04D 29/62*** | (2006.01) |
| ***F04D 31/00*** | (2006.01) |

(52) U.S. Cl.

CPC ..... *F04D 13/10* (2013.01); *F04D 29/2211* (2013.01); *F04D 29/2216* (2013.01); *F04D 29/2238* (2013.01); *F04D 29/2288* (2013.01); *F04D 29/448* (2013.01); *F04D 29/548* (2013.01); *F04D 29/62* (2013.01); *F04D 29/624* (2013.01); *F04D 29/628* (2013.01); *F04D 31/00* (2013.01); *E21B 43/38* (2013.01); *F04D 1/025* (2013.01); *F04D 1/04* (2013.01); *F04D 1/066* (2013.01); *F04D 3/00* (2013.01); *F04D 13/086* (2013.01); *F04D 29/183* (2013.01); *F04D 29/185* (2013.01); *Y10T 29/49243* (2015.01)

(58) Field of Classification Search

CPC ..... F04D 31/00; F04D 29/448; F04D 29/548; F04D 29/2288; F04D 29/62; F04D 29/624; F04D 29/628; E21B 43/128; E21B 43/38; Y10T 29/49243; B23P 15/00; B23P 15/006; B23P 15/02; B23P 15/04

USPC ..... 29/888.024

See application file for complete search history.

(56) References Cited

U.S. PATENT DOCUMENTS

| | | | | |
|---|---|---|---|---|
| 2011/0280706 | A1* | 11/2011 | Meuter | F04D 29/047 415/72 |
| 2011/0280741 | A1* | 11/2011 | Meuter | F04D 29/669 417/205 |
| 2018/0195514 | A1* | 7/2018 | Cheah | F04D 29/0413 |
| 2020/0158135 | A1* | 5/2020 | Bourne | F04D 29/628 |
| 2020/0392960 | A1* | 12/2020 | Stuiver | F04D 3/00 |
| 2021/0355965 | A1* | 11/2021 | De Raeve | F04D 31/00 |

* cited by examiner

HIGH VOLUME AXIAL FLOW ELECTRIC SUBMERSIBLE PUMP (ESP) PUMP STAGE

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift well fluid in a wellbore. Specifically, ESPs may be used to pump the well fluid to the surface in wells with low reservoir pressure. ESPs may be of importance in wells having low bottomhole pressure or for use with well fluids having a low gas/oil ratio, a low bubble point, a high water cut, and/or a low API gravity. Moreover, ESPs may also be used in any production operation to increase the flow rate of the well fluid to a target flow rate.

Generally, an ESP comprises an electric motor, a seal section, a pump intake, and one or more pumps (e.g., a centrifugal pump). These components may all be connected with a series of shafts and couplings. For example, the pump shaft may be coupled to the motor shaft through the intake and seal shafts. An electric power cable provides electric power to the electric motor from the surface. The electric motor supplies mechanical torque to the shafts, which provide mechanical power to the pump. Well fluids, for example well fluids, may enter the wellbore where they may flow past the outside of the motor to the pump intake. These well fluids may then be produced by being pumped to the surface inside the production tubing via the pump, which discharges the well fluids into the production tubing.

The well fluids that enter the ESP may sometimes comprise a gas fraction.

These gases may flow upwards through the liquid portion of the well fluid and may be drawn into the pump. ESP performance can be degraded in the presence of gassy two-phase flow mixture. If a large volume of gas enters the ESP, or if a sufficient volume of gas accumulates on the suction side of the ESP, the gas may interfere with ESP operation and potentially prevent the intake of the well fluid. This phenomenon is sometimes referred to as a "gas lock" because the ESP may not be able to operate properly due to the accumulation of gas within the ESP.

Other oilfield applications may likewise rely on centrifugal pumps. The centrifugal pump may be turned by a hydraulic turbine located downhole or by a pneumatic turbine located downhole. A centrifugal pump may be disposed at the surface in a horizontal position and be driven by an electric motor, a hydraulic turbine, or a pneumatic turbine, for example to pump salt water into an injection well.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
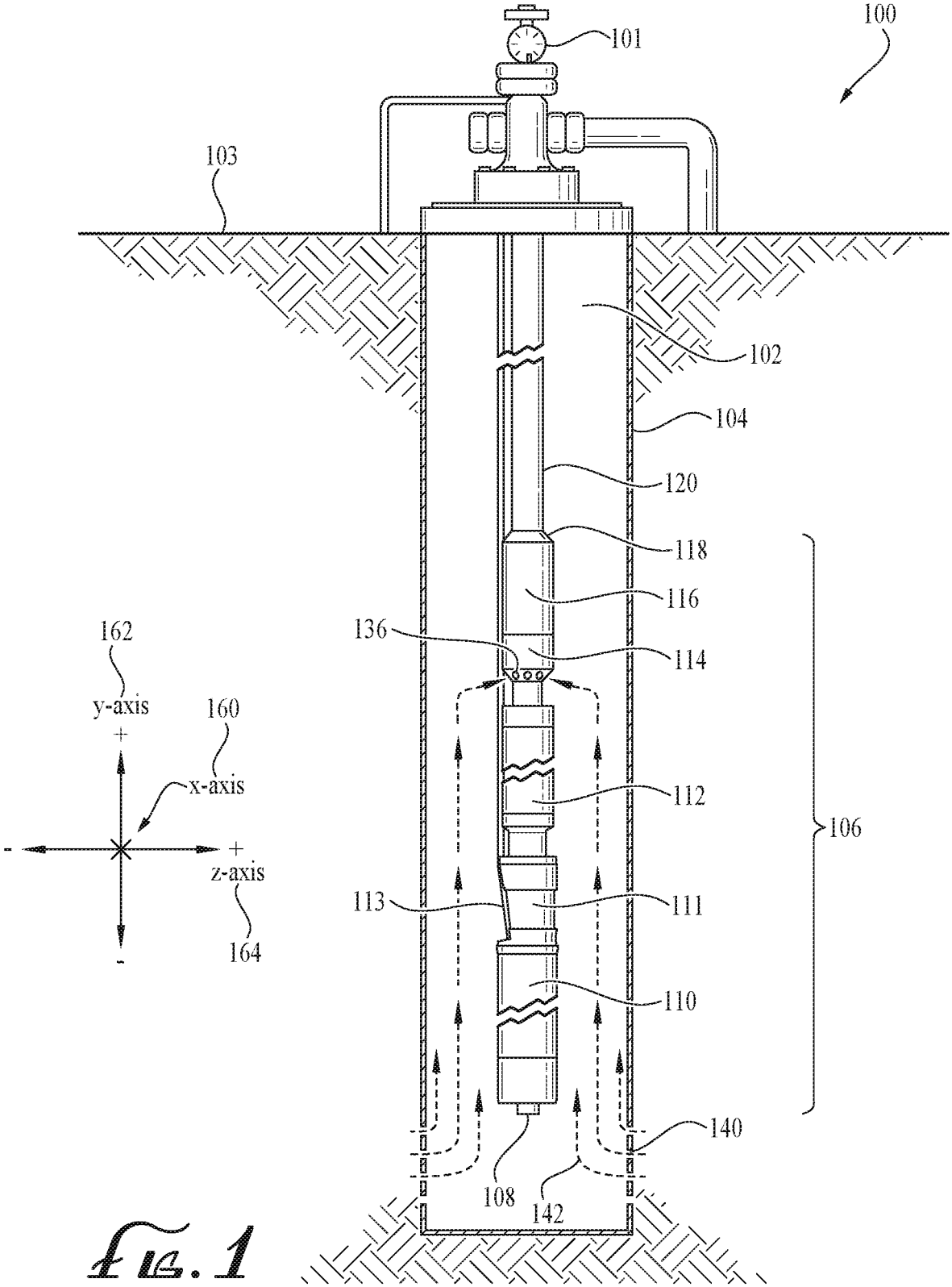
FIG. 1 is an illustration of a completion string disposed in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. As used herein, the term "about" when referring to a measured value or fraction means a range of values +/−5% of the nominal value stated. Thus, "about 1 inch," in this sense of "about," means the range 0.95 inches to 1.05 inches, and "about 5000 PSI," in this sense of "about," means the range 4750 PSI to 5250 PSI. Thus, the fraction "about 8/10s" means the range 76/100s to 84/100s.

The present disclosure teaches a novel centrifugal pump stage structure that provides high volume, axial flow with a new impeller structure and a new diffuser structure. This high volume, axial flow centrifugal pump stage can be applied to provide high fluid flow rates in a low net positive suction head (NPSH) centrifugal pump, for example in a centrifugal pump assembly in an electric submersible pump (ESP) assembly or in a horizontal pump system (HPS). This novel centrifugal pump stage structure also may be advantageously applied in other environments besides the ESP assembly and HPS applications. A plurality of these high volume, axial flow centrifugal pump stages may be provided near the inlet of a centrifugal pump assembly and feed fluid downstream into a plurality of mixed flow or radial flow pump stages, for example in a tapered centrifugal pump. This high volume, axial flow centrifugal pump stage can be applied in a gas separator assembly to supply fluid at a high rate of in-flow to the gas separator.

The high volume, axial flow impeller comprises a shroud structure that has a straight-walled cylindrical shape. The inlet of the impeller extends from an inner hub structure that couples to a drive shaft to the shroud structure. This inlet area is substantially larger than both the inlet area of the conventional mixed flow impeller and the inlet area of the conventional radial flow impeller, and this larger inlet area promotes the higher volume flow capability of this novel impeller. In an embodiment, the inlet area of the impeller is between 1¼ and 3 times the area of an exemplary mixed flow impeller. The high volume, axial flow impeller also features a reduced number of impeller vanes which reduces the risk of a centrifugal pump stage using this impeller becoming gas locked. Because of the reduced number of impeller vanes and because of the larger inlet area, the area that must fill with gas to experience gas lock is much larger, reducing the chances of this problem occurring. The high volume, axial flow diffuser comprises a shroud structure that has a straight-walled cylindrical shape. The outlet of the diffuser extends from an inner hub structure to the shroud structure. This outlet area is substantially larger than the outlet area of the conventional mixed flow diffuser and the inlet area of the conventional radial flow diffuser, promoting a higher volume of fluid flow. In an embodiment, the outlet area is between 1¼ and 3 the area of an exemplary mixed flow diffuser. The pump stage(s) having this high volume, axial flow impeller and diffuser compresses gas that may be present at the inlet, thereby reducing the gas-to-liquid ratio of the wellbore fluid (e.g., reduce the overall gas void fraction), making this wellbore fluid easier to handle by downstream pump stages.

It is thought that the high volume, axial flow centrifugal pump stage taught herein better homogenizes gas phase fluid with liquid phase fluid, whereby to better promote a centrifugal pump lifting wellbore fluid having a higher gas-to-liquid ratio. By better homogenizing gas phase fluid and liquid phase fluid, it is meant that the high volume, axial flow centrifugal pump stage breaks larger diameter gas bubbles into smaller diameter gas bubbles that are more readily entrained in the flow of liquid phase fluid, creating a homogenized gas-liquid mixture. When gas phase fluid and liquid phase fluid are better homogenized, downstream centrifugal pump stages are able to handle well fluid having a higher gas-to-liquid ratio and are less susceptible to gas lock. In an embodiment, a plurality of high volume, axial flow centrifugal pump stages may be disposed in a tapered centrifugal pump at an upstream location and mixed flow or radial flow centrifugal pump stages may be disposed in the tapered centrifugal pump downstream of the high volume, axial flow centrifugal pump stages. In this configuration, the downstream mixed flow or radial flow centrifugal pump stages are more able to handle a higher gas-to-liquid ratio well fluid and avoid gas lock because this well fluid has been better homogenized by the upstream high volume, axial flow centrifugal pump stages. The improved homogenization of gas phase fluid with liquid phase fluid provides similar benefits in a HPS application.

Turning now to FIG. 1 a well site environment 100 showing a completion string disposed in a wellbore, according to one or more aspects of the disclosure, is described. The well site environment 100 comprises a wellbore 102 that is at least partially cased with casing 104. As depicted in FIG. 1, the wellbore 102 is substantially vertical, but the electric submersible pump (ESP) assembly 106 described herein also may be used in a wellbore 102 that has a deviated or horizontal portion. The well site environment 100 may be at an on-shore location or at an off-shore location. The ESP assembly 106 in an embodiment comprises an optional sensor package 108, an electric motor 110, a motor head 111 that couples the electric motor 110 to a seal unit 112, a fluid intake 114 having inlet ports 136, and a centrifugal pump assembly 116. The centrifugal pump assembly 116 comprises a plurality of centrifugal pump stages, and at least some of the pump stages comprise a novel high volume, axial flow impeller and diffuser as disclosed further below.

In an embodiment, the electric motor 110 may be replaced by a hydraulic turbine, a pneumatic turbine, a hydraulic motor, or an air motor, and in this case the assembly 106 may be referred to as a submersible pump assembly. In an embodiment, the ESP assembly 106 may further comprise a gas separator assembly (not shown) that may be located between the fluid intake 114 and the centrifugal pump assembly 116. In an embodiment, the fluid intake 114 may be integrated into a downhole end of the optional gas separator. In an embodiment, the fluid intake 114 may be integrated into a downhole end of the centrifugal pump assembly 116.

The centrifugal pump assembly 116 may couple to a production tubing 120 via a connector 118. An electric cable 113 may attach to the electric motor 110 and extend to the surface 103 to connect to an electric power source. In an embodiment, where the electric motor 110 is replaced by a hydraulic turbine or a hydraulic motor, the electric cable 113 may be replaced by a hydraulic power supply line. In an embodiment, where the electric motor 110 is replaced by a pneumatic turbine or an air motor, the electric cable 113 may be replaced by a pneumatic power supply line. The casing 104 and/or wellbore 102 may have perforations 140 that allow well fluid 142 to pass from the subterranean formation through the perforations 140 and into the wellbore 102. In some contexts, well fluid 142 may be referred to as reservoir fluid.

It will be appreciated that in a different embodiment, the configuration of the ESP assembly 106 may be different. For example, in a bottom-intake design, the fluid intake 114 may be located at the downhole end of the ESP assembly 106, the centrifugal pump assembly 116 may be located uphole of the fluid intake 114, the motor 110 may be located uphole of the centrifugal pump assembly 116, and the seal section 112 may be located uphole of the motor 110. For example, in a through-tubing-conveyed completion, the order of placement of components of the ESP assembly 106 may be altered in various ways, for example with the fluid intake located at the downhole end of the ESP assembly 106, the centrifugal pump assembly 116 located uphole of the fluid intake 114, the seal section 112 located uphole of the centrifugal pump assembly 116, and the motor 110 located uphole of the seal section 112. It is understood that the novel high volume, axial flow centrifugal pump stage disclosed herein can be used to advantage in any of these alternative configurations of the ESP assembly 106.

The well fluid 142 may flow uphole in the wellbore 102 towards the ESP assembly 106, in the inlet ports 136, and into the fluid intake 114. The well fluid 142 may comprise a liquid phase fluid. The well fluid 142 may comprise a gas phase fluid mixed with a liquid phase fluid. The well fluid 142 may comprise only a gas phase fluid (e.g., simply gas). Over time, the gas-to-liquid ratio of the well fluid 142 may change dramatically. For example, in the circumstance of a horizontal or deviated wellbore, gas may build up in high points in the roof of the wellbore and after accumulating sufficiently may "burp" out of these high points and flow downstream to the ESP assembly 106 as what is commonly referred to as a gas slug. Thus, immediately before a gas slug arrives at the ESP assembly 106, the gas-to-liquid ratio of the well fluid 142 may be very low (e.g., the well fluid 142 at the ESP assembly 106 is mostly liquid phase fluid); when the gas slug arrives at the ESP assembly 106, the gas-to-liquid ratio is very high (e.g., the well fluid 142 at the ESP assembly 106 is entirely or almost entirely gas phase fluid); and after the gas slug has passed the ESP assembly 106, the gas-to-liquid ratio may again be very low (e.g., the well fluid 142 at the ESP assembly 106 is mostly liquid phase fluid).

Under normal operating conditions (e.g., well fluid 142 is flowing out of the perforations 140, the ESP assembly 106 is energized by electric power, the electric motor 110 is turning, and a gas slug is not present at the ESP assembly 106), the well fluid 142 enters the inlet ports 136 of the fluid intake 114, flows into the centrifugal pump assembly 116, and the centrifugal pump assembly 116 flows the fluid through the connector 118 and up the production tubing 120 to a wellhead 101 at the surface 103. The centrifugal pump assembly 116 provides pumping pressure or pump head to lift the well fluid 142 to the surface. The well fluid 142 may comprise hydrocarbons such as crude oil and/or natural gas. The well fluid 142 may comprise water. In a geothermal application, the well fluid 142 may comprise hot water. An orientation of the wellbore 102 and the ESP assembly 106 is illustrated in FIG. 1 by an x-axis 160, a y-axis 162, and a z-axis 164.

Figure 2:
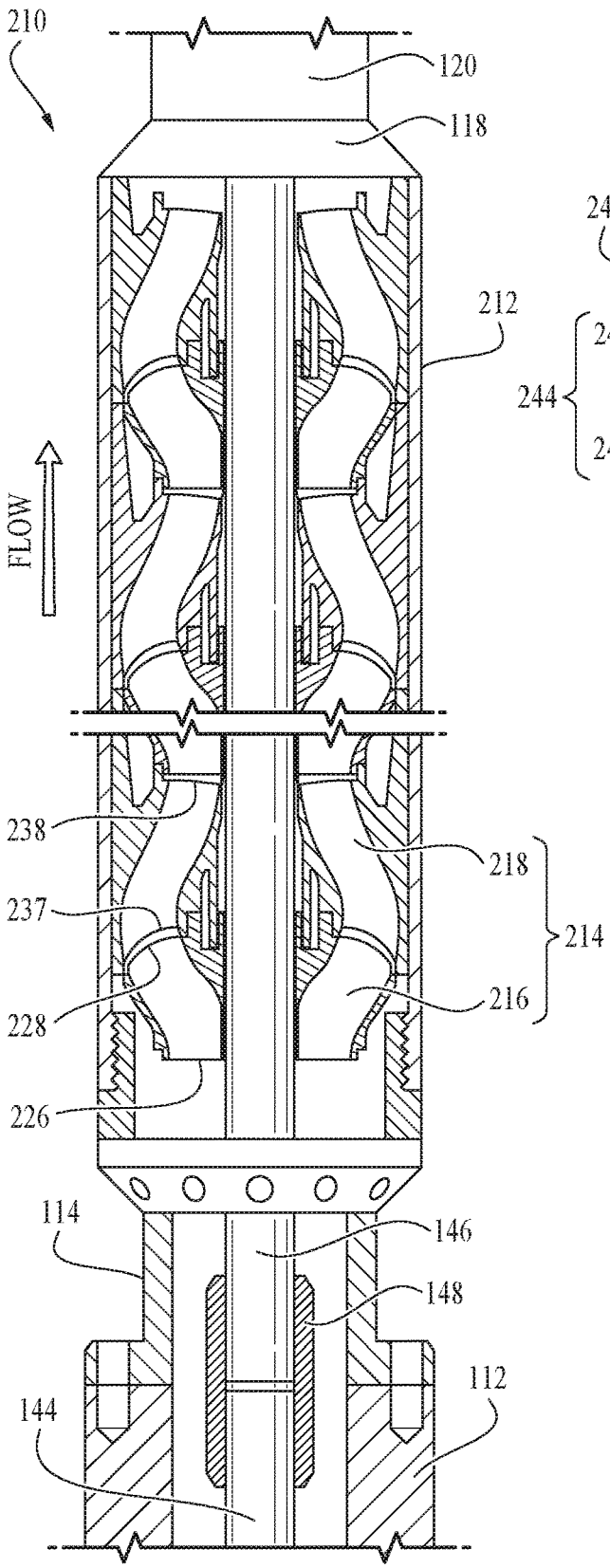
FIG. 2 is an illustration of a plurality of centrifugal pump stages according to an embodiment of the disclosure.

Turning now to FIG. 2, a cross-section view of a plurality of centrifugal pump stages 214 is described. The pump stages 214 are enclosed within a housing 212. Each pump stage 214 comprises an impeller 216 and a diffuser 218. The pump stages 214 illustrated in FIG. 2 are illustrated having a mixed flow pump configuration. The direction of fluid flow through the pump stages 214 has a significant component of radial flow (e.g., a mixed flow of radial and axial flow direction). As well fluid 142 enters an inlet 226 of the impeller 216, it flows both up and radially outwards due to an outwards swelling inside surface of a shroud structure of the impeller 216 and due to deflection by an outer surface of a hub structure of the impeller 216 that swells outwards at an uphole end of the hub structure. As the well fluid 142 flows from an outlet 228 of the impeller 216 and flows into an inlet 237 of the diffuser 218, it flows both uphole and radially inwards due to an inwards curved outer surface of a hub structure at an uphole end of the diffuser 218 and due to deflection by an inner surface of a shroud structure of the diffuser 218 that swells inwards at an outlet 238 at an uphole end of the shroud structure. In other embodiments, however, the pump stages 214 may have a radial flow pump configuration rather than a mixed flow pump configuration.

A drive shaft 144 of the seal section 112 may be coupled to a drive shaft of the electric motor 110 and receive rotational power from the drive shaft of the electric motor 110. An uphole end of the drive shaft 144 of the seal section 112 may be coupled via a coupling shell 148 to a downhole end of a drive shaft 146 of the centrifugal pump assembly 116. The impellers 216 are coupled to the drive shaft 146 of the centrifugal pump assembly (e.g., via a key inserted into keyways defined in the drive shaft and in the inside of the impeller 216), and the diffusers 218 are retained by the housing 212. In an embodiment, the pump stages 214 may be disposed in an uphole location within the centrifugal pump assembly 116.

Figure 3:
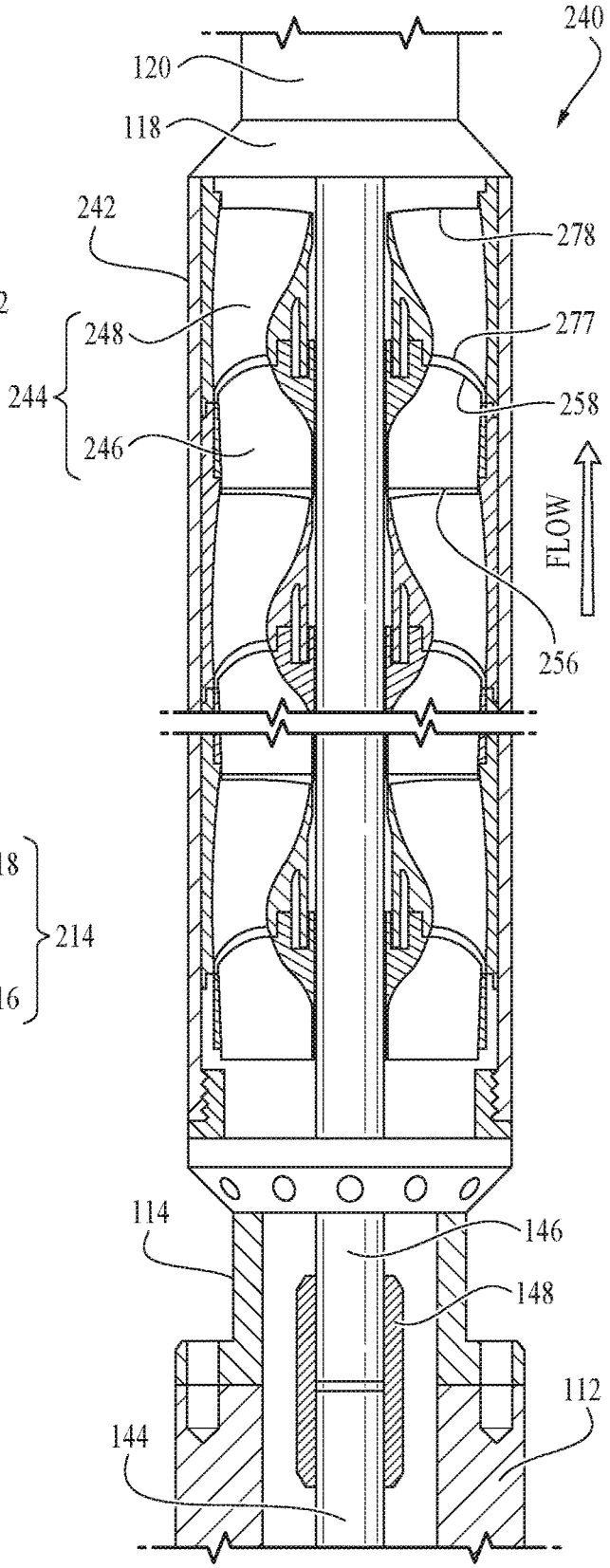
FIG. 3 is an illustration of a plurality of high volume, axial flow centrifugal pump stages according to an embodiment of the disclosure.

Turning now to FIG. 3, a cross-section view of a plurality of centrifugal pump stages 244 is described. The centrifugal pump stages 244 are retained within a housing 242 of a centrifugal pump assembly, for example the centrifugal pump assembly 116 of FIG. 1. Each centrifugal pump stage 244 comprises an impeller 246 and a diffuser 248. The centrifugal pump stages 244 are high volume, axial flow pump stages. While the direction of fluid flow through the centrifugal pump stages 214 discussed above with reference to FIG. 2 has a significant component of radial flow (e.g., a mixed flow of radial and axial flow direction), by contrast, the direction of fluid flow in the centrifugal pump stages 244 is primarily axial. In an embodiment, the centrifugal pump assembly 116 may comprise from one centrifugal pump stage 244 to four hundred centrifugal pump stages 244. In an embodiment, two or more centrifugal pump assemblies 116 are ganged together such that the drive shaft of the downhole centrifugal pump assemblies 116 are coupled to the drive shaft of the adjacent uphole centrifugal pump assemblies 116. In an embodiment, a first centrifugal pump assembly 116 comprising centrifugal pump stages 244 feeds its fluid outlet to the fluid inlet of a second centrifugal pump assembly 116 comprising centrifugal pump stages 214, where the second centrifugal pump assembly 116 is disposed uphole of the first centrifugal pump assembly 116.

An inlet 256 of the impeller 246 is more fully open than the corresponding inlet 226 of the impeller 216 of the mixed flow centrifugal pump stages 214 of FIG. 2. The downhole end of the shroud structure in the impeller 246 lacks the outwards swell seen in the impeller 216 as discussed above with reference to FIG. 2. An outlet 278 of the diffuser 248 is more fully open than the corresponding outlet of the diffuser 218 of the mixed flow centrifugal pump stages 214 of FIG. 2. The impeller 246 has an outlet 258, and the diffuser 248 has an inlet 277. The downhole end of the shroud structure of the diffuser 248 lacks the inward swell seen in the diffuser 218 as discussed above with reference to FIG. 2. The larger area of inlet 256 of the impeller 246 and the larger area of outlet 278 of the diffuser 248 promote a higher volume of fluid flow—a higher fluid flow rate—through the centrifugal pump stages 244. In an embodiment, the centrifugal pump assembly 116 of FIG. 1 comprises a plurality of centrifugal pump stages 244 at a downhole end of the centrifugal pump assembly 116 and comprises centrifugal pump stages 214 uphole of the centrifugal pump stages 244. This may be referred to in some contexts as a tapered centrifugal pump configuration. In an embodiment, the ESP assembly 106 may comprise a first centrifugal pump assembly comprising centrifugal pump stages 244 coupled at a downhole end to an uphole end of the fluid intake 114, a gas separator coupled at a downhole end to an uphole end of the first centrifugal pump assembly, and a second centrifugal pump assembly comprising centrifugal pump stages 214 coupled at a downhole end to an uphole end of the gas separator. The high-volume, axial flow centrifugal pump stages 214 better homogenize gas phase fluid and liquid phase fluid, which provides the benefit that it increases the ability of the centrifugal pump assembly 116 to pump reservoir fluid 142 that has a higher gas-to-liquid ratio and to avoid gas lock.

Figure 4:
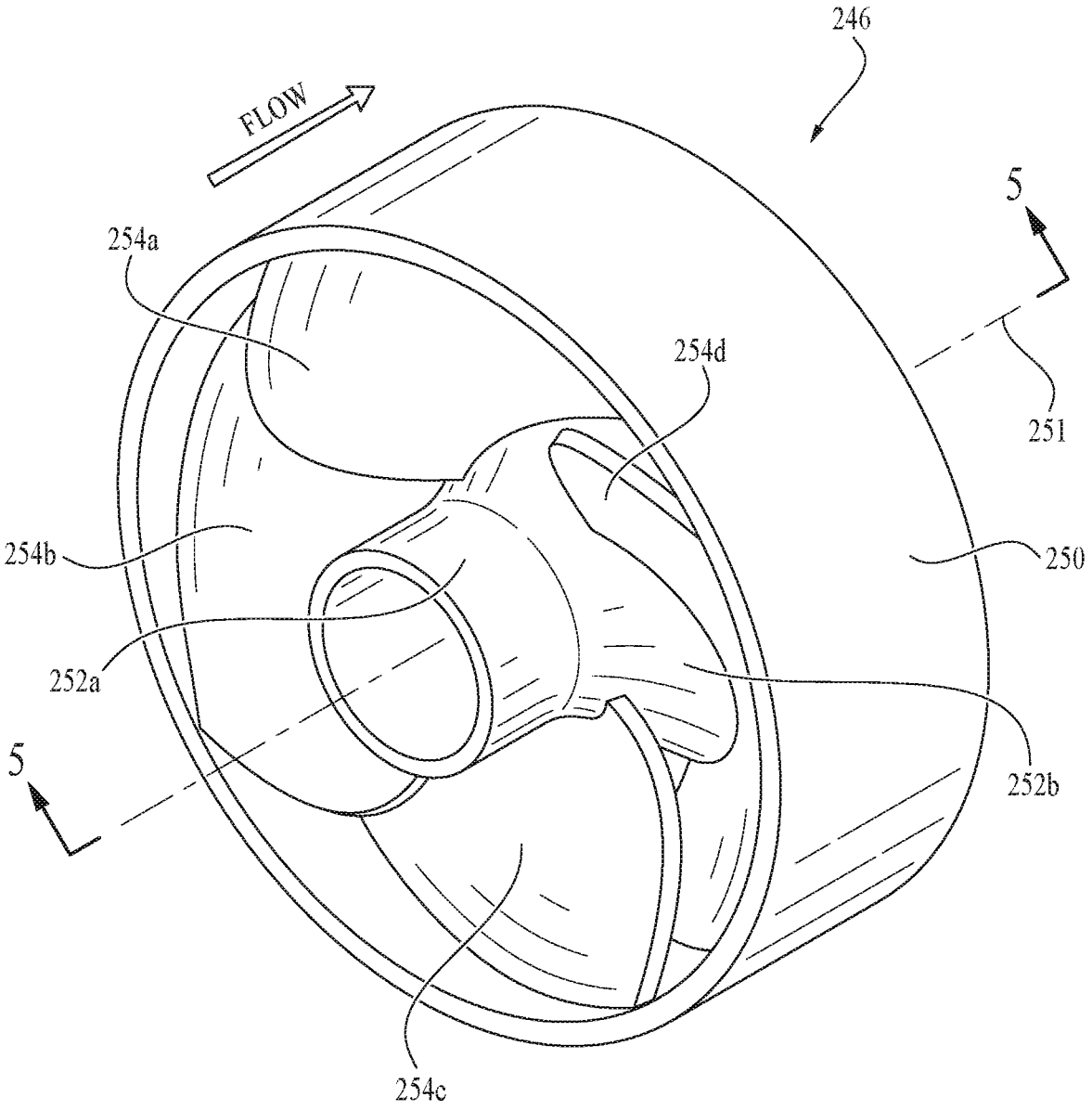
FIG. 4 is an illustration of an impeller of a high volume, axial flow centrifugal pump stage according to an embodiment of the disclosure.
Figure 5:
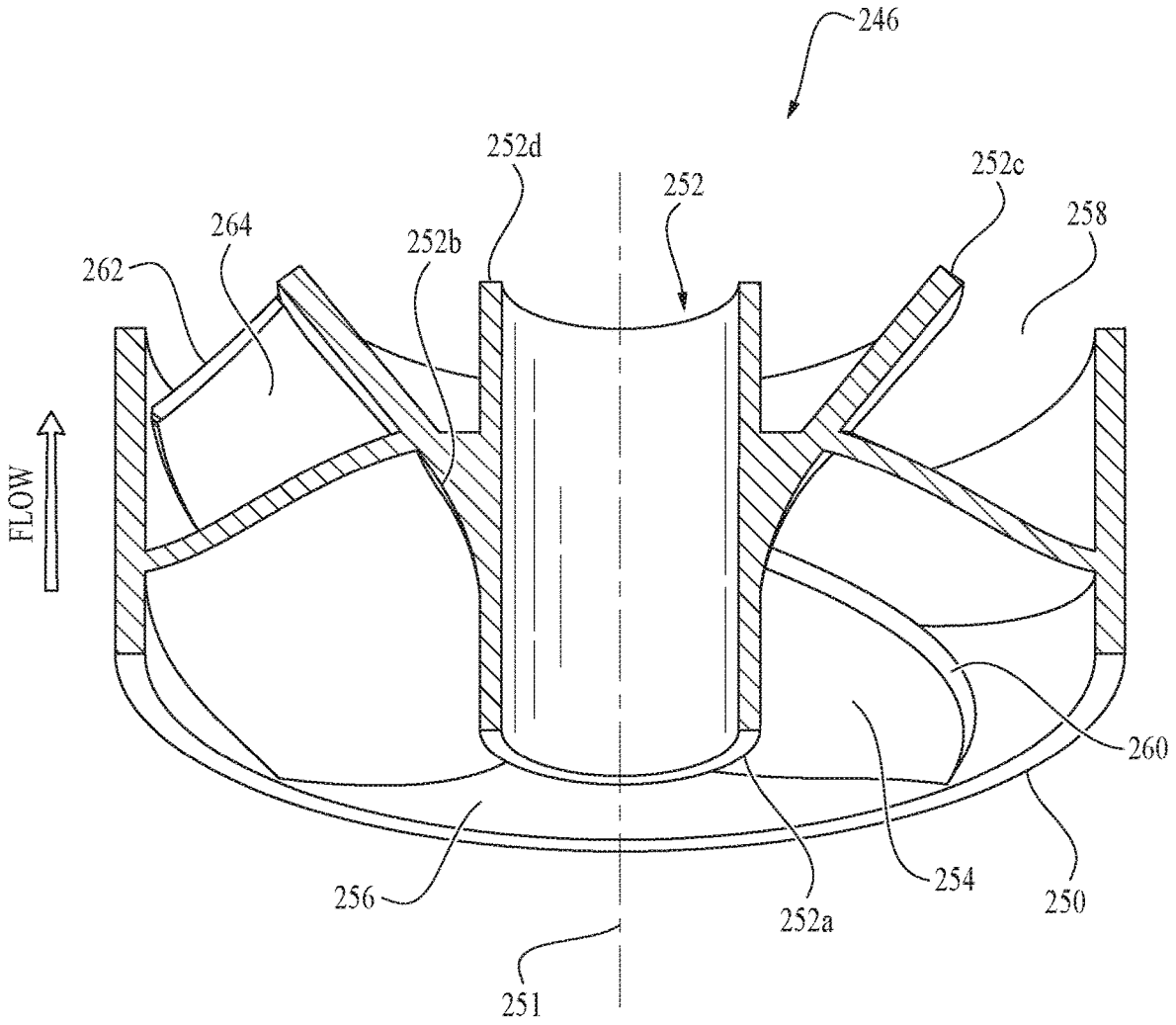
FIG. 5 is another illustration of an impeller of a high volume, axial flow centrifugal pump stage according to an embodiment of the disclosure.

Turning now to FIG. 4 and FIG. 5, further details of the impeller 246 are described. In an embodiment, the impeller 246 is made of metal. In an embodiment, the impeller 246 is manufactured in a casting process. In an embodiment, the impeller 246 is manufactured using a three-dimensional (3D) printing process. The impeller 246 has a centerline axis 251.

In an embodiment, the impeller 246 comprises a first impeller vane 254*a*, a second impeller vane 254*b*, a third impeller vane 254*c*, and a fourth impeller vane 254*d*. In an embodiment, the impeller 246 comprises only three impeller vanes 254. In an embodiment, the impeller 246 may comprise five impeller vanes 254, six impeller vanes 254, seven impeller vanes 254, eight impeller vanes 254, nine impeller vanes 254, ten impeller vanes 254, but less than twenty-five impeller vanes 254. In a preferred embodiment, the impeller 246 comprises four impeller vanes 254.

The impeller 246 has a shroud structure 250 that defines an outer diameter of the impeller 246 and a hub structure 252. While not shown, the inside of the hub structure 252 defines a keyway that may be aligned with a keyway in a drive shaft of the centrifugal pump assembly 116, and the impellers 246 may be coupled to the drive shaft of the centrifugal pump assembly 116 by inserting a key into the aligned keyways of the hub structure 252 and the drive shaft of the centrifugal pump assembly 116. The hub structure 252 comprises an inner barrel portion that is substantially cylindrical from a downhole end of the impeller 246 to an uphole end of the impeller 246. An interior of the impeller shroud (e.g., shroud structure 250) is a straight-walled cylindrical shape along its entire axial extension, wherein a surface of each impeller vane 254 angles downhole from an attachment point at the impeller hub (e.g., hub structure 252) to an attachment point at the impeller shroud. The hub structure 252 comprises only the inner barrel portion at a downhole end at 252*a*. The hub structure 252 swells outwards (radially outwards, away from the centerline 251) to make a shoulder at 252*b*, and splits to form a frustum shape at 252*c* as well as maintaining the inner barrel portion at an uphole end at 252*d*.

The impeller vanes 254 have a leading edge 260 and a trailing edge 262. The leading edge 260 extends from the hub structure 252 to the shroud structure 250. In an embodiment, the leading edge 260 is cupped or curved downhole slightly. For example, if a line were drawn between the points where the leading edge 260 connects with the shroud structure 250 and where the leading edge 260 connects with the hub structure 252, a middle point along the leading edge 260 would be disposed off this line on a downhole side of the line. In an embodiment, this curve of the leading edge 260 departs from this line by between 4 mm and 15 mm, for example in a centrifugal pump assembly 116 having a 4 inch outside diameter. In different diameter pumps, the curve of the leading edge 260 would depart from this line by a linearly scaled amount. For example, in a 3.38 inch outside diameter centrifugal pump assembly 116, the curve of the leading edge 260 may depart from this line between 3.4 mm and 13 mm; in a 5.38 inch outside diameter centrifugal pump assembly 116, the curve of the leading edge 260 may depart from this line between 5.4 mm and 20 mm; and in a 6.75 inch outside diameter centrifugal pump assembly 116, the curve of the leading edge 260 may depart from this line between 6.8 mm and 25 mm. The impeller 246 defines a plurality of flow passages 264 between the hub structure 252, the shroud structure 250, and the impeller vanes 254. The impeller 246 comprises an inlet 256 that extends from the outside diameter of the downhole end of the hub structure at 252*a* to the inside diameter of the shroud structure 250.

It can be seen that the area of this inlet 256 is substantially increased relative to the corresponding inlet area 226 of the impeller 216 of the centrifugal pump stage 214 discussed with reference to FIG. 2. In an embodiment, the inlet 256 of the impeller 246 extends from an outside diameter of the hub structure 252 to more than ninety percent of and less than one hundred percent of an outside diameter of the shroud structure 250. The difference between the outside diameter of the shroud structure 250 and the outer limit of the inlet 256 is the thickness of the metal of the shroud structure 250. Just as an example, assuming the outside diameter of the hub structure 250 at its downhole end is 1.25 inches, the inside diameter of the shroud structure at the inlet of the impeller 216 is 2.5 inches, and the inside diameter of the shroud structure 250 of the impeller 246 is 3.5 inches, the area of the inlet 256 of the impeller 246 is about 2¼ times the area of the corresponding inlet of the impeller 216. In an embodiment, the area of the inlet 256 of the impeller 246 is from 1¼ times to 3 times the corresponding inlet area of a mixed flow impeller. In an embodiment, the area of the inlet 256 of the impeller 246 is from 1¾ times to 2¾ times the corresponding inlet area of a mixed flow impeller. In an embodiment, the area of the inlet 256 is from 2 times to 2½ times the corresponding inlet area of a mixed flow impeller. The use of a relatively small number of impeller vanes 254 (e.g., the use of four impeller vanes 254 in a preferred embodiment), the use of downhole-curved leading edges 260 of the impeller vanes 254, and the increased area of the inlet 256 reduces the susceptibility of the high volume, axial flow centrifugal pump stage 244 to gas locking.

Figure 6:
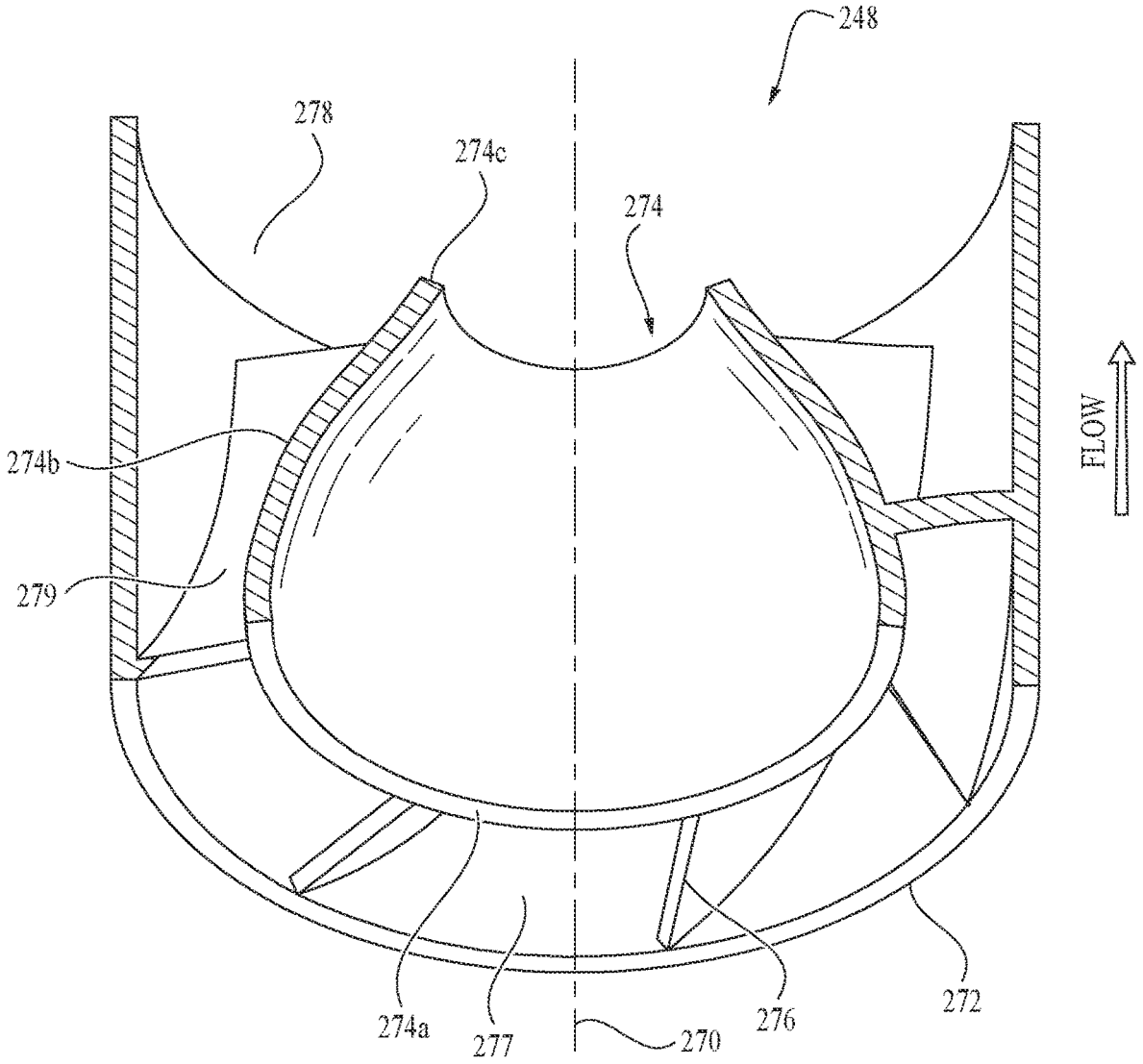
FIG. 6 is an illustration of a diffuser of a high volume, axial flow centrifugal pump stage according to an embodiment of the disclosure.

Turning now to FIG. 6, further details of the diffuser 248 are described. In an embodiment, the diffuser 248 is made of metal. In an embodiment, the diffuser 248 is manufactured in a casting process. In an embodiment, the diffuser 248 is manufactured using a three-dimensional (3D) printing process. The diffuser 248 has a centerline axis 270. The diffuser 248 comprises a shroud structure 272 and a hub structure 274. The shroud structure 272 defines a substantially straight-walled cylinder structure. The diffuser 248 defines a plurality of diffuser vanes 276, where a leading edge of each vane 276 extends from the hub structure at downhole end 274*a* to the shroud structure 272. In an embodiment, the diffuser 248 defines fewer diffuser vanes 276 than the number of vanes 254 of the impeller 246, an equal number of diffuser vanes 276 as the number of vanes 254 of the impeller 246, or a greater number of diffuser vanes 276 than the number of vanes 254 of the impeller 246. In an embodiment, the diffuser has three diffuser vanes 276, four diffuser vanes 276, five diffuser vanes 276, six diffuser vanes 276, seven diffuser vanes 276, eight diffuser vanes 276, nine diffuser vanes 276, ten diffuser vanes 276, eleven diffuser vanes 276, twelve diffuser vanes 276, or more than twelve diffuser vanes 276 and less than thirty diffuser vanes 276. In an embodiment, the diffuser 248 defines more than four diffuser vanes 276 and less than thirty diffuser vanes 276. In a preferred embodiment, the impeller has four vanes 254, and the diffuser has seven diffuser vanes 276

As the hub structure 274 extends from a downhole end at 274*a*, to a middle portion at 274*b*, to an uphole end at 274*c* it defines a partial bell-shape. The diffuser 248 has an inlet 277 at a downhole end and an outlet 278 at an uphole end. The diffuser 248 defines a plurality of flow passages 279 between an outside of the hub structure 274, an inside of the shroud structure 272, and the diffuser vanes 276.

It can be seen that the area of the outlet 278 is substantially increased relative to the corresponding outlet area of the diffuser 218 of the centrifugal pump stage 214 discussed with reference to FIG. 2. In an embodiment, the outlet 278 of the diffuser 248 extends from an outside diameter of the hub structure at 274*c* to more than ninety percent of and less than one hundred percent of an outside diameter of the shroud structure 272. The difference between the outside diameter of the shroud structure 272 and the outer limit of the outlet 278 is the thickness of the metal of the shroud structure 272. For example, the area of the outlet 278 may be as much as 2¼ times the area of the corresponding outlet of the diffuser 218. In an embodiment, the area of the outlet 278 is from 1¼ times to 3 times the corresponding outlet area of a mixed flow diffuser. In an embodiment, the area of the outlet 278 is from 1¾ times to 2¾ times the corresponding outlet area of a mixed flow diffuser. In an embodiment, the area of the outlet 278 is from 2 times to 2½ times the corresponding outlet area of a mixed flow diffuser.

Figure 7:
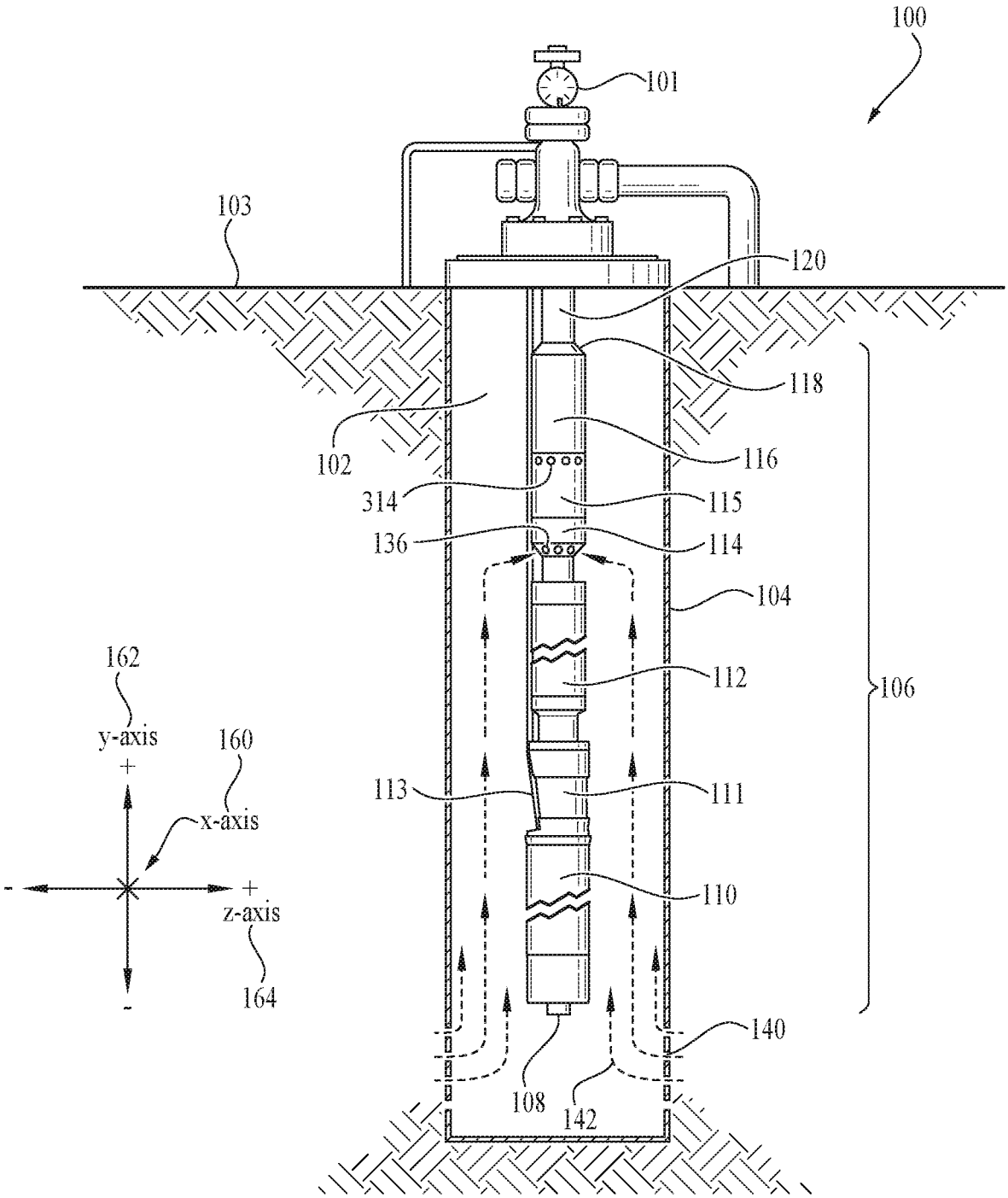
FIG. 7 is an illustration of another completion string disposed in a wellbore according to an embodiment of the disclosure.

Turning now to FIG. 7, an alternate embodiment of the ESP assembly 106 is described. The well site environment 100 is substantially similar to that illustrated in FIG. 1, with the difference that the ESP assembly 106 comprises a gas separator assembly 115 defining a plurality of gas phase discharge ports 314 disposed at an uphole end of the gas separator assembly 115.

Figure 8:
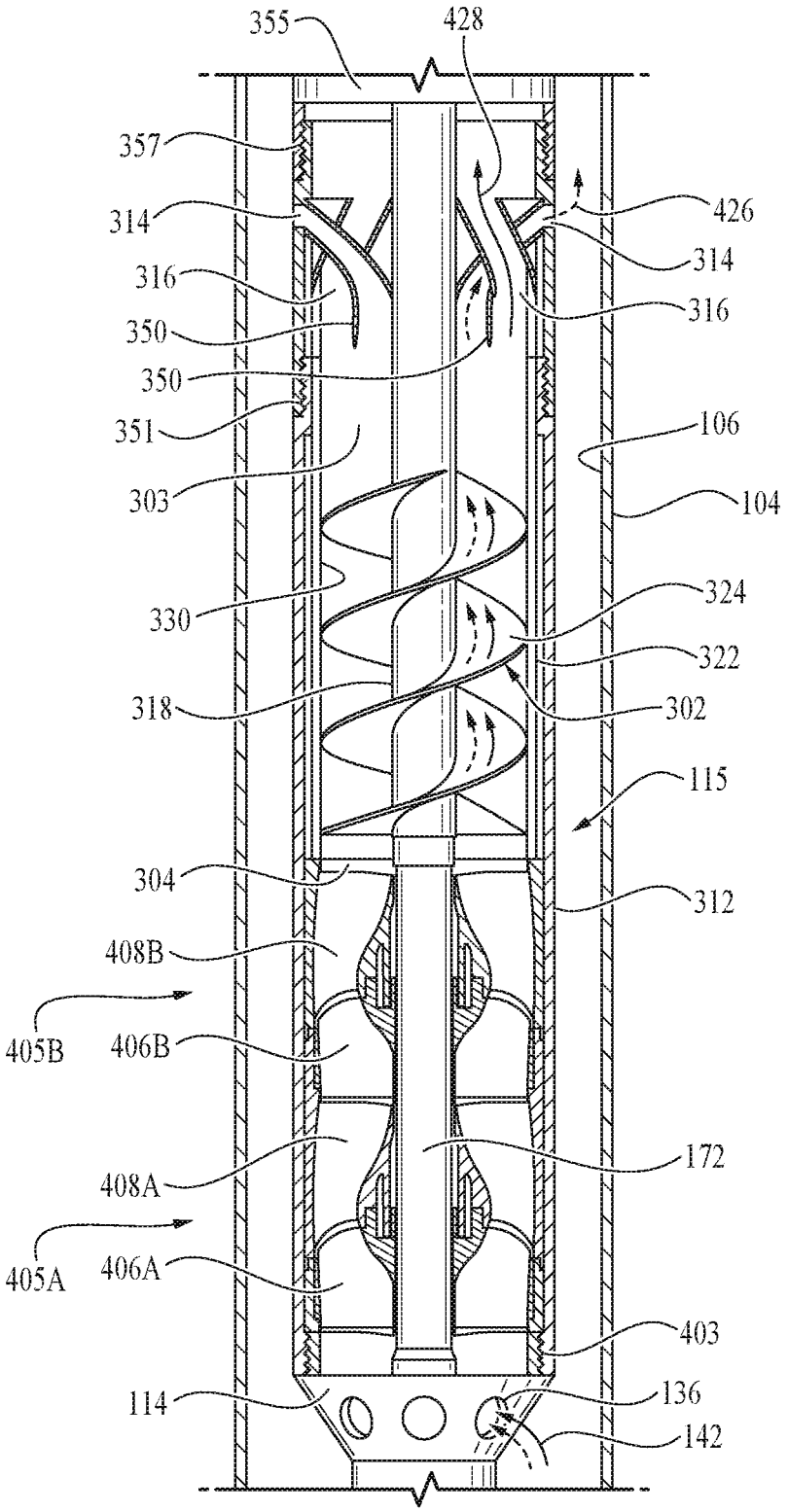
FIG. 8 is an illustration of a gas separator assembly according to an embodiment of the disclosure.

Turning now to FIG. 8, further details of the gas separator assembly 115 are described. A downhole end of the gas separator assembly 115 is coupled to an uphole end of the fluid intake 114. The gas separator assembly 115 comprises a housing 312, a crossover 350, and a head 355. The head 355 may allow for bolting the gas separator assembly 115 to a base of the centrifugal pump assembly 116. The housing 312 may be a cylindrical hollow metal pipe. In an embodiment, an inside of the housing 312 may be machined or drilled at one or more locations to create slots or shallow holes for fixing and retaining components within the housing 312, for example diffusers or other components.

In an embodiment, the housing 312 encloses a plurality of centrifugal pump stages 405, for example a first centrifugal pump stage 405A and a second centrifugal pump stage 405B. Each centrifugal pump stage 405 comprises an impeller 406 mechanically coupled to a drive shaft 172 of the gas separator assembly 115 and a diffuser 408 that is retained and held stationary by the housing 312. In an embodiment, the impeller 406 may have a keyway that mates with a keyway in the drive shaft 172 and the keyway of the impeller 406 may be secured to the keyway in the drive shaft 172 by a key. In an embodiment, the impeller 406 may be mechanically coupled to the drive shaft 172 in a different way. When the drive shaft 172 turns, the impeller 406 turns. The first centrifugal pump stage 405A comprises a first impeller 406A and a first diffuser 408A; the second centrifugal pump stage 405B comprises a second impeller 406B and a second diffuser 408B. While two centrifugal pump stages 405A and 405B are illustrated in FIG. 8, in another embodiment, there may be a single centrifugal pump stage 405, three centrifugal pump stages 405, four centrifugal pump stages 405, five centrifugal pump stages 405, six centrifugal pump stages 405, or more centrifugal pump stages 405 located between the base 410 and the fluid reservoir 172. The centrifugal pump stages 405 may be referred to as a first fluid mover in some contexts.

In an embodiment, the centrifugal pump stages 405 are the same as the centrifugal pump stages 244 described above with reference to FIG. 3, FIG. 4, FIG. 5, and FIG. 6. In an embodiment, when the centrifugal pump stages 405 are the same as the centrifugal pump stages 244, the centrifugal pump assembly 116 may not include centrifugal pump stages 244 and only has mixed flow centrifugal pump stages (e.g., centrifugal pump stages 214) and/or radial flow centrifugal pump stages. In an embodiment, the centrifugal pump stages 405 of the gas separator assembly 115 are replaced by another fluid mover mechanism, for example replaced by an auger mechanically coupled to the drive shaft 172, one or more impeller mechanically coupled to the drive shaft 172 (e.g., without a corresponding diffuser), and/or a paddle wheel mechanically coupled to the drive shaft 172.

In an embodiment, the drive shaft 172 is mechanically coupled to a drive shaft of the seal unit 112, and the drive shaft of the seal unit 112 is mechanically coupled to a drive shaft of the electric motor 110. Thus, the drive shaft 172 and the impellers 406 (e.g., impellers 406A and 406B in FIG. 2) of the one or more centrifugal pump stages 405 are turned indirectly by the electric motor 110 when it is energized by electric power via the electric cable 113. The drive shaft 172 is mechanically coupled to a drive shaft of the centrifugal pump assembly 116 and transfers rotational power to the drive shaft of the centrifugal pump assembly 116 and to impellers of the centrifugal pump stages of the centrifugal pump assembly 116. The several different drive shaft mechanical couplings may be provided by splines cut in the mating ends of shafts and coupled by a spline coupler or hub. In another embodiment, the drive shaft mechanical couplings may be provided by other devices.

In an embodiment, the housing 312 also encloses a stationary auger 302. In one or more embodiments, the stationary auger 302 is disposed or positioned within a sleeve 322. The centrifugal pump stages 405 communicates or forces well fluid 142 received at the one or more inlet ports 136 through the stationary auger 302. In an embodiment, an outside edge of the stationary auger 302 engages sealingly with an inside surface 330 of the sleeve 322, and the flow of well fluid 142 through the sleeve 322 is hence confined to the passageway or passageways defined by the stationary auger 302. The sleeve 322 may be disposed or positioned within and retained by the housing 312. In an embodiment, the stationary auger 302 and the sleeve 322 may be built or manufactured as a single component.

In an embodiment, there is no sleeve 322 and the stationary auger 302 is disposed within the inside of the housing 312. The stationary auger 302 may be retained by the inside of the housing 312. In an embodiment, the stationary auger 302 engages sealingly with an inside surface of the housing 312. In an embodiment, there is a space between the outside edges of the stationary auger 302 and the inside surface 330 of the sleeve 332 or a space between the outside edges of the stationary auger 302 and the inside surface of the housing 312.

In one or more embodiments, the stationary auger 302 comprises one or more helixes or vanes 324. In one or more embodiments, the helixes or vanes 324 may be crescent-shaped. In one or more embodiments, the stationary auger 302 comprises one or more helixes or vanes 324 disposed about a solid core, for example shaft 318 that encloses the drive shaft 172, or an open core (for example, a coreless auger or an auger flighting). The stationary auger 302 may cause the well fluid 142 to be separated into a liquid phase 308 and gas phase 306 based, at least in part, on rotational flow of the well fluid 142.

For example, the one or more helixes or vanes 324 may impart rotation to the well fluid 142 as the well fluid 142 flows through, across or about the one or more helixes or vanes 324. The stationary auger 302, then, can be referred to as a fluid mover at least because it imparts a rotating motion to the well fluid 142 as the well fluid 142 flows through the stationary auger 302. For example, fluid mover 310 forces the well fluid 142 at a velocity or flow rate into the sleeve 322 and up or across the one or more helixes or vanes 324 of stationary auger 302. The rotation of the well fluid 142 induced by the stationary auger 302 may be based, at least in part, on the velocity or flow rate of the well fluid 142 generated by the centrifugal pump stages 405. For example, the centrifugal pump stages 405 may increase the flow rate or velocity of the well fluid 142 to increase rotation of the well fluid 142 through the stationary auger 302 to create a more efficient and effective separation of the well fluid 142 into a plurality of phases, for example, a liquid phase fluid 428 and a gas phase fluid 426. As the well fluid 142 flows through the stationary auger 302, centrifugal forces, static friction or both, cause the heavier component of the well fluid 142, a liquid phase fluid 428, to circulate along an outer perimeter of the stationary auger 302 while the lighter component of the well fluid 142, the gas phase fluid 426, is circulated along an inner perimeter of the stationary auger 302. In one or more embodiments, well fluid 142 may begin to separate while flowing through stationary auger 302. In one or more embodiments, the liquid phase fluid 428 may comprise residual gas that did not separate into the gas phase fluid 426. However, the embodiments discussed herein reduce this residual gas to protect the centrifugal pump assembly 116 from gas build-up or gas lock.

In an embodiment, the stationary auger 302 is not present and instead a different kind of second fluid mover is provided. The second fluid mover may be provided by an auger mechanically coupled to the drive shaft 172, a paddle wheel mechanically coupled to the drive shaft 172, a centrifuge rotor mechanically coupled to the drive shaft 172, or an impeller mechanically coupled to the drive shaft 172 that induce rotating motion of the well fluid 142. In an embodiment, a third fluid mover is provided downstream of the stationary auger 302, for example a paddle wheel may be installed downstream of the stationary auger 172 that induces and/or increases rotating motion of the well fluid 142.

A separation chamber 303 is provided downstream of the second fluid mover (e.g., the stationary auger 302) and downstream of the optional third fluid mover. An upstream end of the separation chamber 303 is fluidically coupled to a downstream end or an outlet of the stationary auger 302 or other second fluid mover. Alternatively, the upstream end of the separation chamber 303 is fluidically coupled to a downstream end or an outlet of the optional third fluid mover and is fluidically coupled to the third fluid mover and, via the third fluid mover, fluidically coupled to the second fluid mover. The separation chamber 303 is defined by an annulus formed between the inside of the housing 312 and the outside of the drive shaft 172. In an embodiment, the separation chamber is less than 36 inches long and at least 4 inches long, at least 6 inches long, at least 8 inches long, at least 10 inches long, at least 12 inches long, or at least 14 inches long. In an embodiment, the separation chamber is at least 6 inches long and less than 17 inches long. The stationary auger 302 (or other second fluid mover and/or third fluid mover) induces a rotating motion in the well fluid 142. As the well fluid 142 exits the stationary auger 302 (or other second fluid mover and/or third fluid mover) and enters the separation chamber 303, this rotating motion of the well fluid 142 continues. The rotating motion of the well fluid 142 within the separation chamber 303 induces gas phase fluid (which is less dense than the liquid phase fluid) to concentrate near the drive shaft 172 and the liquid phase fluid to concentrate near the inside surface of the housing 312.

In one or more embodiments, the separated fluids (for example, liquid phase fluid 428 and gas phase fluid 426) are directed to a crossover 350. For example, the crossover 350 may be disposed or positioned at a downstream end of the separation chamber 303 or housing 312. In some contexts, the crossover 350 may be referred to as a gas flow path and liquid flow path separator. The crossover 350 may comprise a plurality of channels or define a plurality of channels, for example, a gas phase discharge 314 (a first pathway) and a liquid phase discharge 316 (a second pathway). A gas phase fluid 426 of the well fluid 142 may be discharged through the gas phase discharge 314, out the gas phase discharge ports 138, and a liquid phase fluid 428 of the well fluid 142 may be discharged through the liquid phase discharge 316.

In one or more embodiments, any one or more of the gas phase discharge ports 314 and the one or more liquid phase discharge ports 316 may be defined by a channel or pathway having an opening, for example, a teardrop shaped opening, a round opening, an elliptical opening, a triangular opening, a square opening, or another shaped opening. The crossover 350 may be threadingly coupled at an upstream end by threaded coupling 351 to a downstream end of the housing 312. The crossover 350 may be threadingly coupled at a downstream end by threaded coupling 357 to a head 355. Alternatively, the head 355 may be integrated with the head 355 rather than threadingly coupled to the head 355. The head 355 may provide bolt holes for coupling to an upstream end of the centrifugal pump assembly 116. In some contexts, the crossover 350 may be said to be mechanically coupled at an upstream end to a downstream end of the housing 312. When the crossover 350 and the head 355 are not integrated as a single component, the crossover 350 may be said to be mechanically coupled at a downstream end to an upstream end of the head 355. In an embodiment, two or more instances of gas separator assemblies 115 are connected in series, such that the drive shafts of each adjacent gas separator assembly 115 couples to the corresponding adjacent gas separator assembly 115, and wherein the liquid phase discharge 316 of the adjacent downhole gas separator assembly 115 feeds into the fluid inlet of the adjacent uphole gas separator assembly 115.

Figure 9:
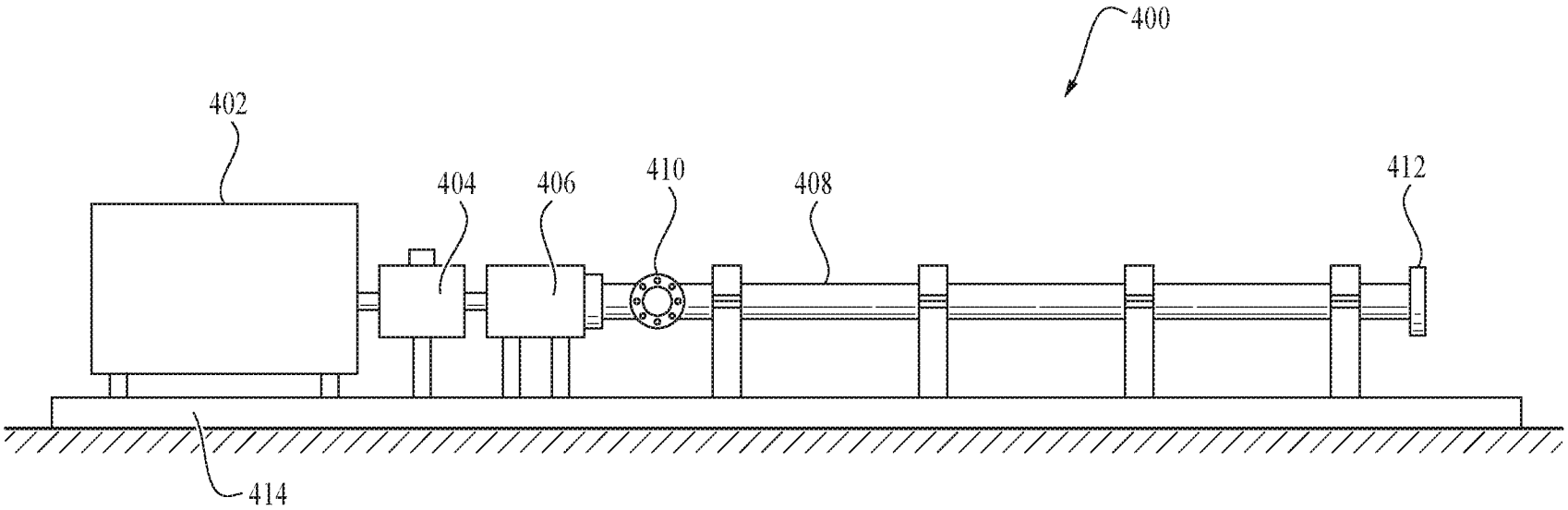
FIG. 9 is an illustration of a horizontal pump system (HPS) according to an embodiment of the disclosure.

Turning now to FIG. 9, a horizontal pumping system (HPS) 400 is described. In an embodiment, the HPS 400 comprises a motor 402, a rotational coupling 404, a mechanical seal 406, and a centrifugal pump assembly 408. In an embodiment, a fluid inlet 410 is integrated into a first end of the centrifugal pump assembly 408 and a fluid outlet 412 may be integrated into a second end of the centrifugal pump assembly 408. The motor 402, the rotational coupling 404, the mechanical seal 406, and the centrifugal pump assembly 408 may be mounted on a skid 414 such that it can be easily transported to a location on a truck and placed on the ground at the location. The centrifugal pump assembly 408 is substantially similar to the centrifugal pump assembly 116 described above with reference to FIG. 1, FIG. 3, FIG. 4, FIG. 5 and FIG. 6. For example, the centrifugal pump assembly 408 comprises a plurality of pump stages 244 with an impeller 246 and a diffuser 248 as described above with reference to FIG. 3, FIG. 4, FIG. 5, and FIG. 6, where each pump stage comprises the impeller 246 coupled to a drive shaft of the centrifugal pump assembly 408 and the diffuser 248 that is retained by a housing of the centrifugal pump assembly 408. In an embodiment, the centrifugal pump assembly 408 comprises from one to four hundred pump stages 244.

The motor 402 may be an electric motor, a hydraulic turbine, or an air turbine. When the motor 402 turns, the drive shaft of the centrifugal pump assembly 408 turns, turning the impellers of the centrifugal pump assembly 408. The torque provided by the motor 402 is transferred via the rotational coupling 404 to the drive shaft of the centrifugal pump assembly 408.

The HPS 400 may be applied for use in a variety of different surface operations. The HPS 400 can be used as a crude oil pipeline pressure and/or flow booster. The HPS 400 can be used in a mine dewatering operation (e.g., removing water from a mine). The HPS 400 can be used in geothermal energy applications, for example to pump geothermal water from a wellhead through a pipe to an end-use or energy conversion facility. The HPS 400 can be used in carbon sequestration operations. The HPS 400 can be used in salt water disposal operations, for example receiving salt water from a wellbore and pumping the salt water under pressure down into a disposal well. The HPS 400 can be used in desalinization operations. In any of these surface pumping applications, the novel impeller and diffuser structures taught above can advantageously be applied to increase the efficiency of the centrifugal pump assembly 408, to increase the head and/or flow rate produced by the centrifugal pump assembly 408, and/or increase the service life of the centrifugal pump assembly.

Figure 10:
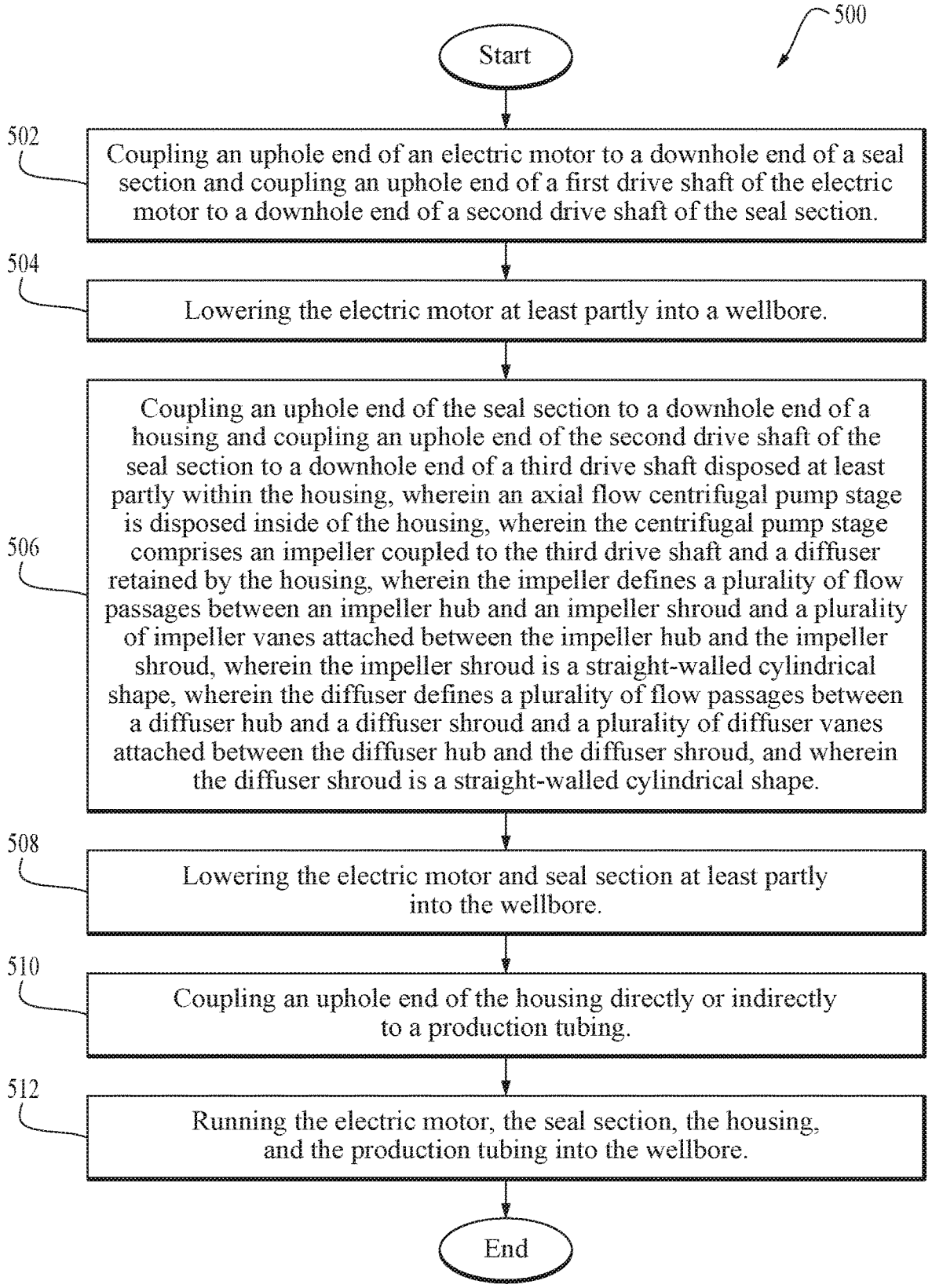
FIG. 10 is a flow chart of a method according to an embodiment of the disclosure.

Turning now to FIG. 10, a method 500 is descried. In an embodiment, the method 500 is a method of assembling an electric submersible pump (ESP) assembly. At block 502, the method 500 comprises coupling an uphole end of an electric motor to a downhole end of a seal section and coupling an uphole end of a first drive shaft of the electric motor to a downhole end of a second drive shaft of the seal section. At block 504, the method 500 comprises lowering the electric motor at least partly into a wellbore.

At block 506, the method 500 comprises coupling an uphole end of the seal section to a downhole end of a housing and coupling an uphole end of the second drive shaft of the seal section to a downhole end of a third drive shaft disposed at least partly within the housing, wherein an axial flow centrifugal pump stage is disposed inside of the housing, wherein the centrifugal pump stage comprises an impeller coupled to the third drive shaft and a diffuser retained by the housing, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape. In an embodiment, the impeller defines an inlet opening that extends from an outside diameter of a downhole end of the impeller hub to more than ninety percent of and less than one hundred percent of an outside diameter of a downhole end of the impeller shroud. In an embodiment, the diffuser defines an outlet opening that extends from an outside diameter of an uphole end of the diffuser to more than ninety percent of and less than one hundred percent of an outside diameter of an uphole end of the diffuser shroud.

In an embodiment, a leading edge of each of the impeller vanes is cupped in a downhole direction. In an embodiment, the housing and the third drive shaft are part of a centrifugal pump assembly, wherein the axial flow centrifugal pump stage is disposed inside the centrifugal pump assembly. In an embodiment, the housing and the third drive shaft are part of a gas separator assembly, wherein the axial flow centrifugal pump stage is disposed inside the gas separator assembly.

At block 508, the method 500 comprises lowering the electric motor and seal section at least partly into the wellbore. At block 510, the method 500 comprises coupling an uphole end of the housing directly or indirectly to a production tubing. At block 512, the method 500 comprises running the electric motor, the seal section, the housing, and the production tubing into the wellbore. In an embodiment, the method 500 further comprises coupling an uphole end of a gas separator to a downhole end of a centrifugal pump assembly; and coupling an uphole end of the centrifugal pump assembly directly to the production tubing, wherein the housing of the gas separator assembly is indirectly coupled to the production tubing. In an embodiment, the method 500 further comprises pumping a well fluid by the centrifugal pump assembly while avoiding gas lock and lifting a well fluid up the production tubing.

Figure 11:
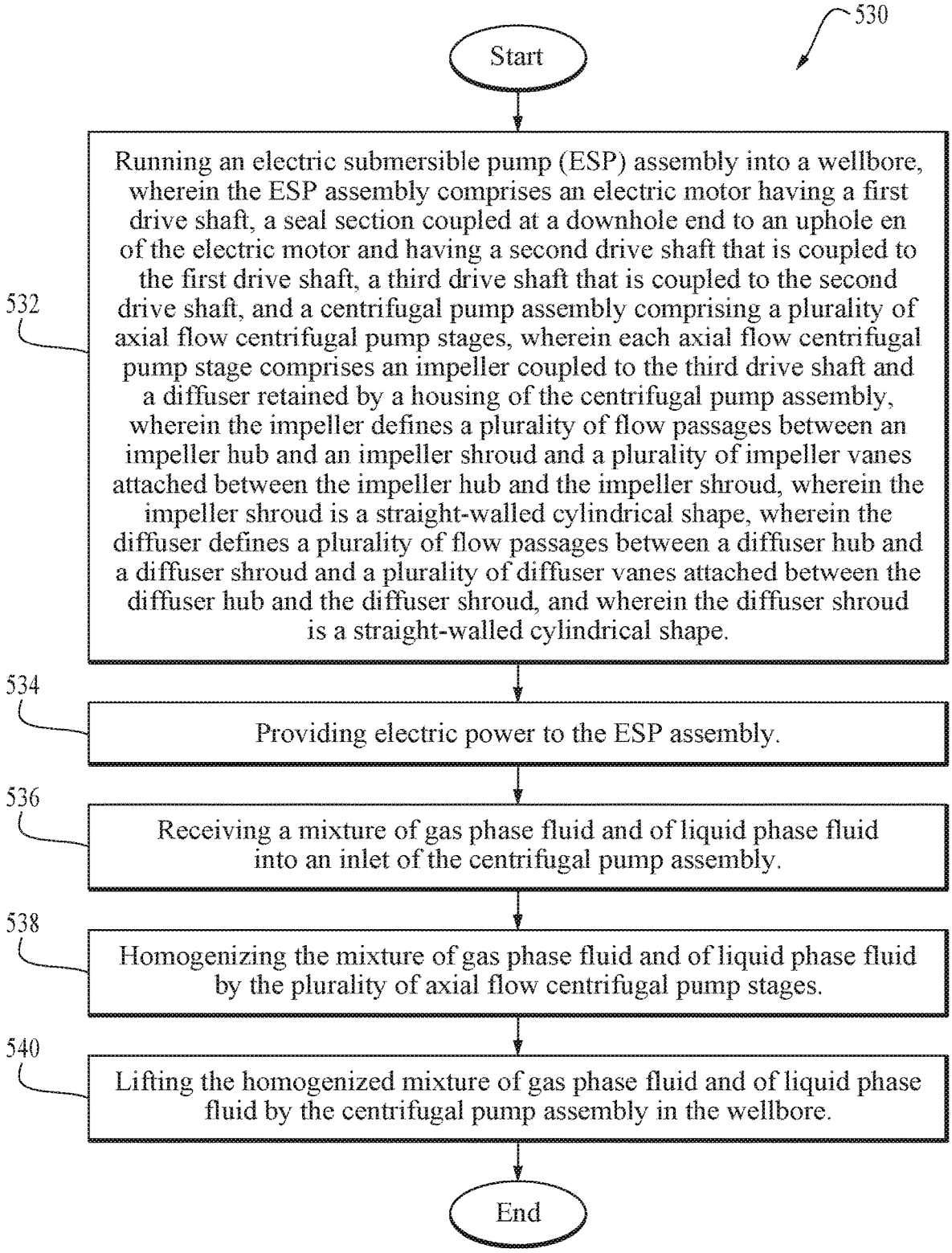
FIG. 11 is a flow chart of another method according to an embodiment of the disclosure.

Turning now to FIG. 11, a method 530 is described. In an embodiment, the method 530 is a method of lifting fluid in a wellbore. At block 532, the method 530 comprises running an electric submersible pump (ESP) assembly into a wellbore. The ESP assembly of block 532 comprises an electric motor having a first drive shaft, a seal section coupled at a downhole end to an uphole end of the electric motor and having a second drive shaft that is coupled to the first drive shaft, and a third drive shaft that is coupled to the second drive shaft. The ESP assembly of block 532 further comprises a centrifugal pump assembly comprising a plurality of axial flow centrifugal pump stages, wherein each axial flow centrifugal pump stage comprises an impeller coupled to the third drive shaft and a diffuser retained by a housing of the centrifugal pump assembly, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape. In an embodiment, the centrifugal pump assembly comprises a tapered centrifugal pump and the axial flow centrifugal pump stage is disposed at a downhole end of the centrifugal pump assembly. In an embodiment, the centrifugal pump assembly comprises between one and four hundred axial flow centrifugal pump stages. In an embodiment, the impeller of each axial flow centrifugal pump stage defines four impeller vanes. In an embodiment, the impeller of each axial flow centrifugal pump stage defines an inlet opening that extends from an outside diameter of a downhole end of the impeller hub to more than ninety percent of and less than one hundred percent of an outside diameter of a downhole end of the impeller shroud. In an embodiment, the diffuser of each axial flow centrifugal pump stage defines an outlet opening that extends from an outside diameter of an uphole end of the diffuser to more than ninety percent of and less than one hundred percent of an outside diameter of an uphole end of the diffuser shroud.

At block 534, the method 530 comprises providing electric power to the ESP assembly. At block 536, the method 530 comprises receiving a mixture of gas phase fluid and of liquid phase fluid into an inlet of the centrifugal pump assembly.

At block 538, the method 530 comprises homogenizing the mixture of gas phase fluid and of liquid phase fluid by the plurality of axial flow centrifugal pump stages. In an embodiment, the processing of block 538 further comprises avoiding gas lock by the plurality of axial flow centrifugal pump stages. At block 540, the method 530 comprises lifting the homogenized mixture of gas phase fluid and of liquid phase fluid by the centrifugal pump assembly in the wellbore.

Additional Embodiments

The following are non-limiting, specific embodiments in accordance with the present disclosure:

A first embodiment, which is a horizontal pumping system (HPS) comprising a motor comprising a first drive shaft; and a centrifugal pump assembly comprising a second drive shaft that is coupled directly or indirectly to the first drive shaft of the motor and a plurality of pump stages, wherein at least some of the pump stages are axial flow pump stages that comprise an impeller coupled to the second drive shaft and a diffuser retained by a housing of the centrifugal pump assembly, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape.

A second embodiment, which is the HPS of the first embodiment, wherein the centrifugal pump assembly comprises a tapered pump centrifugal pump and the axial flow pump stages are disposed at an upstream end of the tapered pump centrifugal pump.

A third embodiment, which is the HPS of the first or second embodiment, wherein the impeller defines four impeller vanes.

A fourth embodiment, which is the HPS of any of the first through the third embodiment, wherein the impeller defines an inlet opening that extends from an outside diameter of a downhole end of the impeller hub to more than ninety percent of and less than one hundred percent of an outside diameter of a downhole end of the impeller shroud.

A fifth embodiment, which is the HPS of any of the first through the fourth embodiment, wherein the diffuser defines an outlet opening that extends from an outside diameter of an uphole end of the diffuser to more than ninety percent of and less than one hundred percent of an outside diameter of an uphole end of the diffuser shroud.

A sixth embodiment, which is the HPS of any of the first through the fifth embodiment, wherein the HPS is used in a crude oil pipeline booster application.

A seventh embodiment, which is the HPS of any of the first through the fifth embodiment, wherein the HPS is used in a mine dewatering application.

An eighth embodiment, which is the HPS of any of the first through the fifth embodiment, wherein the HPS is used in a geothermal application.

A ninth embodiment, which is the HPS of any of the first through the fifth embodiment, wherein the HPS is used.

A tenth embodiment, which is the HPS of any of the first through the fifth embodiment, wherein the HPS is used in a carbon sequestration application.

An eleventh embodiment, which is the HPS of any of the first through the fifth embodiment, wherein the HPA is used in a salt water disposal application.

A twelfth embodiment, which is the HPS of the first through the eleventh embodiment, wherein the motor is an electric motor.

A thirteenth embodiment, which is the HPS of the first through the eleventh embodiment, wherein the motor is a hydraulic turbine motor.

A fourteenth embodiment, which is the HPS of the first through the eleventh embodiment, wherein the motor is an air turbine motor.

A fifteenth embodiment, which is a method of pumping a fluid, comprising installing a horizontal pump system (HPS) at a surface location, wherein the HPS comprises a motor and a centrifugal pump assembly, wherein the centrifugal pump assembly is configured according to any of the first through the fifteenth embodiment; providing rotating power by the motor to the drive shaft of the centrifugal pump; receiving the fluid into a fluid inlet at a first end of the centrifugal pump assembly; pumping the fluid by the centrifugal pump assembly; and flowing the fluid out a fluid outlet at a second end of the centrifugal pump assembly.

A sixteenth embodiment, which is an electrical submersible pump (ESP) assembly comprising an electric motor having a first drive shaft; a seal section coupled at a downhole end to an uphole end of the electric motor and having a second drive shaft that is coupled to the first drive shaft; a third drive shaft that is coupled to the second drive shaft; and an axial flow centrifugal pump stage disposed inside of a housing disposed uphole of the seal section, wherein the centrifugal pump stage comprises an impeller coupled to the third drive shaft and a diffuser retained by the housing, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape.

A seventeenth embodiment, which is the ESP assembly of the sixteenth embodiment, wherein the axial flow centrifugal pump stage is disposed inside of a housing of a centrifugal pump assembly.

An eighteenth embodiment, which is the ESP assembly of the seventeenth embodiment, wherein the centrifugal pump assembly comprises a tapered centrifugal pump and the axial flow centrifugal pump stage is disposed at a downhole end of the centrifugal pump assembly.

A nineteenth embodiment, which is the ESP assembly of any of the sixteenth through the eighteenth embodiment, wherein the axial flow centrifugal pump stage is disposed inside of a housing of a gas separator assembly.

A twentieth embodiment, which is the ESP assembly of any of the sixteenth through the nineteenth embodiment, wherein the impeller defines four impeller vanes.

A twenty-first embodiment, which is the ESP assembly of any of the sixteenth through the twentieth embodiment, wherein the diffuser defines more than four diffuser vanes and less than thirty diffuser vanes.

A twenty-second embodiment, which is the ESP assembly of any of the sixteenth through the twenty-first embodiment, wherein the diffuser defines seven diffuser vanes.

A twenty-third embodiment, which is the ESP assembly of any of the sixteenth through the twenty-first embodiment, wherein the impeller defines an inlet opening that extends from an outside diameter of a downhole end of the impeller hub to more than ninety percent of and less than one hundred percent of an outside diameter of a downhole end of the impeller shroud.

A twenty-fourth embodiment, which is the ESP assembly of any of the sixteenth through the twenty-third embodiment, wherein the diffuser defines an outlet opening that extends from an outside diameter of an uphole end of the diffuser to more than ninety percent of and less than one hundred percent of an outside diameter of an uphole end of the diffuser shroud.

A twenty-fifth embodiment, which is the ESP assembly of any of the sixteenth through the twenty-fourth embodiment, wherein the impeller defines an inlet opening and an outlet opening, where an area of the inlet opening of the impeller is greater than an area of the outlet opening of the impeller.

A twenty-sixth embodiment, which is the ESP assembly of any of the sixteenth through the twenty-fifth embodiment, wherein the diffuser defines an inlet opening and an outlet opening, where an area of the inlet opening of the diffuser is smaller than an area of the outlet opening of the diffuser.

A twenty-seventh embodiment, which is a method of assembling an electric submersible pump (ESP) assembly according to any of the sixteenth through the twenty-sixth embodiment, comprising coupling an uphole end of the electric motor to a downhole end of the seal section and coupling an uphole end of a first drive shaft of the electric motor to a downhole end of a second drive shaft of the seal section; lowering the electric motor at least partly into a wellbore; coupling an uphole end of the seal section to a downhole end of the housing and coupling an uphole end of the second drive shaft of the seal section to a downhole end of a third drive shaft disposed at least partly within the housing, wherein an axial flow centrifugal pump stage is disposed inside of the housing; lowering the electric motor and seal section at least partly into the wellbore; coupling an uphole end of the housing directly or indirectly to a production tubing; and running the electric motor, the seal section, the housing, and the production tubing into the wellbore.

A twenty-eighth embodiment, which is a method of assembling an electric submersible pump (ESP) assembly comprising coupling an uphole end of an electric motor to a downhole end of a seal section and coupling an uphole end of a first drive shaft of the electric motor to a downhole end of a second drive shaft of the seal section; lowering the electric motor at least partly into a wellbore; coupling an uphole end of the seal section to a downhole end of a housing and coupling an uphole end of the second drive shaft of the seal section to a downhole end of a third drive shaft disposed at least partly within the housing, wherein an axial flow centrifugal pump stage is disposed inside of the housing, wherein the centrifugal pump stage comprises an impeller coupled to the third drive shaft and a diffuser retained by the housing, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape; lowering the electric motor and seal section at least partly into the wellbore; coupling an uphole end of the housing directly or indirectly to a production tubing; and running the electric motor, the seal section, the housing, and the production tubing into the wellbore.

A twenty-ninth embodiment, which is the method of the twenty-eighth embodiment, wherein the housing and the third drive shaft are part of a centrifugal pump assembly, wherein the axial flow centrifugal pump stage is disposed inside the centrifugal pump assembly.

A thirtieth embodiment, which is the method of the twenty-eighth or twenty-ninth embodiment, wherein the housing and the third drive shaft are part of a gas separator assembly, wherein the axial flow centrifugal pump stage is disposed inside the gas separator assembly.

A thirty-first embodiment, which is the method of the thirtieth embodiment, further comprising coupling an uphole end of the gas separator to a downhole end of a centrifugal pump assembly; and coupling an uphole end of the centrifugal pump assembly directly to the production tubing, wherein the housing of the gas separator assembly is indirectly coupled to the production tubing.

A thirty-second embodiment, which is the method of any of the twenty-eighth through the thirty-first embodiment, wherein a leading edge of each of the impeller vanes is cupped in a downhole direction.

A thirty-third embodiment, which is the method of any of the twenty-eighth through the thirty-second embodiment, wherein the impeller defines an inlet opening that extends from an outside diameter of a downhole end of the impeller hub to more than ninety percent of and less than one hundred percent of an outside diameter of a downhole end of the impeller shroud.

A thirty-fourth embodiment, which is the method of any of the twenty-eight through the thirty-third embodiment, wherein the diffuser defines an outlet opening that extends from an outside diameter of an uphole end of the diffuser to more than ninety percent of and less than one hundred percent of an outside diameter of an uphole end of the diffuser shroud.

A thirty-fifth embodiment, which is a method of lifting fluid in a wellbore, comprising running the electric submersible pump (ESP) assembly of any of the sixteenth through the twenty-sixth embodiment, into a wellbore comprising providing electric power to the ESP assembly; receiving a mixture of gas phase fluid and of liquid phase fluid into an inlet associated with the housing; homogenizing the mixture of gas phase fluid and of liquid phase fluid by the axial flow centrifugal pump stage; and lifting the homogenized mixture of gas phase fluid and of liquid phase fluid by the ESP assembly in the wellbore.

A thirty-sixth embodiment, which is a method of lifting fluid in a wellbore comprising running an electric submersible pump (ESP) assembly into a wellbore, wherein the ESP assembly comprises an electric motor having a first drive shaft, a seal section coupled at a downhole end to an uphole end of the electric motor and having a second drive shaft that is coupled to the first drive shaft, a third drive shaft that is coupled to the second drive shaft, and a centrifugal pump assembly comprising a plurality of axial flow centrifugal pump stages, wherein each axial flow centrifugal pump stage comprises an impeller coupled to the third drive shaft and a diffuser retained by a housing of the centrifugal pump assembly, wherein the impeller defines a plurality of flow passages between an impeller hub and an impeller shroud and a plurality of impeller vanes attached between the impeller hub and the impeller shroud, wherein the impeller shroud is a straight-walled cylindrical shape, wherein the diffuser defines a plurality of flow passages between a diffuser hub and a diffuser shroud and a plurality of diffuser vanes attached between the diffuser hub and the diffuser shroud, and wherein the diffuser shroud is a straight-walled cylindrical shape; providing electric power to the ESP assembly; receiving a mixture of gas phase fluid and of liquid phase fluid into an inlet of the centrifugal pump assembly; homogenizing the mixture of gas phase fluid and of liquid phase fluid by the plurality of axial flow centrifugal pump stages; and lifting the homogenized mixture of gas phase fluid and of liquid phase fluid by the centrifugal pump assembly in the wellbore.

A thirty-seventh embodiment, which is the method of the thirty-sixth embodiment, wherein the centrifugal pump assembly comprises a tapered centrifugal pump and the axial flow centrifugal pump stage is disposed at a downhole end of the centrifugal pump assembly.

A thirty-eighth embodiment, which is the method of the thirty-sixth embodiment, or the thirty-seventh embodiment, wherein the centrifugal pump assembly comprises between one and four hundred axial flow centrifugal pump stages.

A thirty-ninth embodiment, which is the method of any of the thirty-sixth through the thirty-eighth embodiment, wherein the impeller of each axial flow centrifugal pump stage defines four impeller vanes.

A fortieth embodiment, which is the method of any of the thirty-sixth through the thirty-ninth embodiment, wherein the impeller of each axial flow centrifugal pump stage defines an inlet opening that extends from an outside diameter of a downhole end of the impeller hub to more than ninety percent of and less than one hundred percent of an outside diameter of a downhole end of the impeller shroud.

A forty-first embodiment, which is the method of any of the thirty-sixth through the fortieth embodiment, wherein the diffuser of each axial flow centrifugal pump stage defines an outlet opening that extends from an outside diameter of an uphole end of the diffuser to more than ninety percent of and less than one hundred percent of an outside diameter of an uphole end of the diffuser shroud.

A forty-second embodiment, which is the ESP assembly of any of the sixteenth through the twenty-sixth embodiment, wherein the ESP assembly comprises from one axial flow centrifugal pump stage to four hundred axial flow centrifugal pump stages.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electrical submersible pump (ESP) assembly, comprising:

an electric motor having a first drive shaft;

a seal section coupled at a downhole end to an uphole end of the electric motor and having a second drive shaft that is coupled to the first drive shaft;

a third drive shaft that is coupled to the second drive shaft; and a centrifugal pump stage disposed inside of a housing disposed uphole of the seal section, wherein the centrifugal pump stage comprises an impeller coupled to the third drive shaft and a diffuser retained by the housing, wherein the impeller defines a plurality of flow passages between an impeller hub and an impeller shroud and a plurality of impeller vanes attached between the impeller hub and the impeller shroud, wherein an interior of the impeller shroud is a straight-walled cylindrical shape along its entire axial extension, wherein a surface of each impeller vane angles downhole from an attachment point at the impeller hub to an attachment point at the impeller shroud, wherein a leading edge of each of the impeller vanes is cupped downhole so that a middle point along the leading edge of each of the impeller vanes departs downhole from a line extending from a first point where the leading edge attaches to the impeller hub and to a second point where the leading edge attaches to the impeller shroud by between 4 mm and 15 mm, wherein the hub defines an inner barrel opening that surrounds the third drive shaft, wherein the diffuser defines a plurality of flow passages between a diffuser hub and a diffuser shroud and a plurality of diffuser vanes attached between the diffuser hub and the diffuser shroud, and wherein an interior of the diffuser shroud is a straight-walled cylindrical shape along its entire axial extension.

2. The ESP of claim 1, wherein the centrifugal pump stage is disposed inside of the housing of a centrifugal pump assembly.

3. The ESP of claim 2, wherein the centrifugal pump assembly comprises a tapered centrifugal pump and the centrifugal pump stage is disposed at a downhole end of the centrifugal pump assembly.

4. The ESP of claim 1, wherein the centrifugal pump stage is disposed inside of the housing of a gas separator assembly.

5. The ESP of claim 1, wherein the impeller defines four impeller vanes.

6. The ESP of claim 5, wherein the diffuser defines more than four diffuser vanes.

7. The ESP of claim 6, wherein the diffuser defines seven diffuser vanes.

8. The ESP of claim 1, wherein the impeller defines an inlet opening that extends from an outside diameter of a downhole end of the impeller hub to more than ninety percent of and less than one hundred percent of an outside diameter of a downhole end of the impeller shroud.

9. The ESP of claim 1, wherein the diffuser defines an outlet opening that extends from an outside diameter of an uphole end of the diffuser to more than ninety percent of and less than one hundred percent of an outside diameter of an uphole end of the diffuser shroud.

10. The ESP of claim 1, wherein the impeller defines an inlet opening and an outlet opening, where an area of the inlet opening of the impeller is greater than an area of the outlet opening of the impeller.

11. The ESP of claim 10, wherein the diffuser defines an inlet opening and an outlet opening, where an area of the inlet opening of the diffuser is smaller than an area of the outlet opening of the diffuser.

12. The ESP assembly of claim 1, wherein the centrifugal pump assembly comprises between one and four hundred centrifugal pump stages.

13. A method of assembling an electric submersible pump (ESP) assembly, comprising:

coupling an uphole end of an electric motor to a downhole end of a seal section and coupling an uphole end of a first drive shaft of the electric motor to a downhole end of a second drive shaft of the seal section;

lowering the electric motor at least partly into a wellbore;

coupling an uphole end of the seal section to a downhole end of a housing and coupling an uphole end of the second drive shaft of the seal section to a downhole end of a third drive shaft disposed at least partly within the housing, wherein a centrifugal pump stage is disposed inside of the housing, wherein the centrifugal pump stage comprises an impeller coupled to the third drive shaft and a diffuser retained by the housing, wherein the impeller defines a plurality of flow passages between an impeller hub and an impeller shroud and a plurality of impeller vanes attached between the impeller hub and the impeller shroud, wherein an interior of the impeller shroud is a straight-walled cylindrical shape along its entire axial extension, wherein a surface of each impeller vane angles downhole from an attachment point at the impeller hub to an attachment point at the impeller shroud, wherein a leading edge of each of the impeller vanes is cupped downhole so that a middle point along the leading edge of each of the impeller vanes departs downhole from a line extending from a first point where the leading edge attaches to the impeller hub and to a second point where the leading edge attaches to the impeller shroud by between 4 mm and 15 mm, wherein the hub defines an inner barrel opening that surrounds the third drive shaft, wherein the diffuser defines a plurality of flow passages between a diffuser hub and a diffuser shroud and a plurality of diffuser vanes attached between the diffuser hub and the diffuser shroud, and wherein an interior of the diffuser shroud is a straight-walled cylindrical shape along its entire axial extension;

lowering the electric motor and seal section at least partly into the wellbore;

coupling an uphole end of the housing directly or indirectly to a production tubing; and running the electric motor, the seal section, the housing, and the production tubing into the wellbore.

14. The method of claim 13, wherein the housing and the third drive shaft are part of a centrifugal pump assembly, wherein the centrifugal pump stage is disposed inside the centrifugal pump assembly.

15. The method of claim 14, wherein the centrifugal pump assembly comprises a tapered centrifugal pump and the centrifugal pump stage is disposed at a downhole end of the centrifugal pump assembly.

16. The method of claim 13, wherein the housing and the third drive shaft are part of a gas separator assembly, wherein the centrifugal pump stage is disposed inside the gas separator assembly.

17. The method of claim 16, further comprising:

coupling an uphole end of the gas separator to a downhole end of a centrifugal pump assembly; and coupling an uphole end of the centrifugal pump assembly directly to the production tubing, wherein the housing of the gas separator assembly is indirectly coupled to the production tubing.

18. The method of claim 13, wherein the impeller defines an inlet opening that extends from an outside diameter of a downhole end of the impeller hub to more than ninety percent of and less than one hundred percent of an outside diameter of a downhole end of the impeller shroud.

19. The method of claim 18, wherein the diffuser defines an outlet opening that extends from an outside diameter of an uphole end of the diffuser to more than ninety percent of and less than one hundred percent of an outside diameter of an uphole end of the diffuser shroud.

20. A method of lifting fluid in a wellbore, comprising:

running an electric submersible pump (ESP) assembly into the wellbore, wherein the ESP assembly comprises an electric motor having a first drive shaft, a seal section coupled at a downhole end to an uphole end of the electric motor and having a second drive shaft that is coupled to the first drive shaft, a third drive shaft that is coupled to the second drive shaft, and a centrifugal pump assembly comprising a plurality of centrifugal pump stages, wherein each centrifugal pump stage comprises an impeller coupled to the third drive shaft and a diffuser retained by a housing of the centrifugal pump assembly, wherein the impeller defines a plurality of flow passages between an impeller hub and an impeller shroud and a plurality of impeller vanes attached between the impeller hub and the impeller shroud, wherein an interior of the impeller shroud is a straight-walled cylindrical shape along its entire axial extension, wherein a surface of each impeller vane angles downhole from an attachment point at the impeller hub to an attachment point at the impeller shroud, wherein a leading edge of each of the impeller vanes is cupped downhole so that a middle point along the leading edge of each of the impeller vanes departs downhole from a line extending from a first point where the leading edge attaches to the impeller hub and to a second point where the leading edge attaches to the impeller shroud by between 4 mm and 15 mm, wherein the hub defines an inner barrel opening that surrounds the third drive shaft, wherein the diffuser defines a plurality of flow passages between a diffuser hub and a diffuser shroud and a plurality of diffuser vanes attached between the diffuser hub and the diffuser shroud, and wherein an interior of the diffuser shroud is a straight-walled cylindrical shape along its entire axial extension;

providing electric power to the ESP assembly;

receiving a mixture of gas phase fluid and of liquid phase fluid into an inlet of the centrifugal pump assembly;

homogenizing the mixture of gas phase fluid and of liquid phase fluid by the plurality of centrifugal pump stages; and lifting the homogenized mixture of gas phase fluid and of liquid phase fluid by the centrifugal pump assembly in the wellbore.

21. The method of claim 20, wherein the centrifugal pump assembly comprises a tapered centrifugal pump and the plurality of centrifugal pump stages are disposed at a downhole end of the centrifugal pump assembly.

22. The method of claim 20, wherein the centrifugal pump assembly comprises between one and four hundred centrifugal pump stages.

23. The method of claim 20, wherein the impeller of each centrifugal pump stage defines four impeller vanes.

24. The method of claim 20, wherein the impeller of each centrifugal pump stage defines an inlet opening that extends from an outside diameter of a downhole end of the impeller hub to more than ninety percent of and less than one hundred percent of an outside diameter of a downhole end of the impeller shroud.

25. The method of claim 20, wherein the diffuser of each centrifugal pump stage defines an outlet opening that extends from an outside diameter of an uphole end of the diffuser to more than ninety percent of and less than one hundred percent of an outside diameter of an uphole end of the diffuser shroud.

* * * * *